US007840402B2

(12) United States Patent
Sato et al.

(10) Patent No.: US 7,840,402 B2
(45) Date of Patent: Nov. 23, 2010

(54) AUDIO ENCODING DEVICE, AUDIO DECODING DEVICE, AND METHOD THEREOF

(75) Inventors: Kaoru Sato, Kanagawa (JP); Toshiyuki Morii, Kanagawa (JP); Tomofumi Yamanashi, Tokyo (JP)

(73) Assignee: Panasonic Corporation, Osaka (JP)

( * ) Notice: Subject to any disclaimer, the term of this patent is extended or adjusted under 35 U.S.C. 154(b) by 1005 days.

(21) Appl. No.: 11/630,380

(22) PCT Filed: Jun. 16, 2005

(86) PCT No.: PCT/JP2005/011061

§ 371 (c)(1),
(2), (4) Date: Dec. 22, 2006

(87) PCT Pub. No.: WO2006/001218

PCT Pub. Date: Jan. 5, 2006

(65) Prior Publication Data

US 2007/0250310 A1 Oct. 25, 2007

(30) Foreign Application Priority Data

Jun. 25, 2004 (JP) ..... 2004-188755

(51) Int. Cl.
*G10L 19/00* (2006.01)

(52) U.S. Cl. ..... 704/219; 704/220; 704/221; 704/229

(58) Field of Classification Search ..... 704/219, 704/220, 221, 229
See application file for complete search history.

(56) References Cited

U.S. PATENT DOCUMENTS 5,751,900 A 5/1998 Serizawa
RE36,721 E * 5/2000 Akamine et al. ..... 704/220

(Continued)

FOREIGN PATENT DOCUMENTS

EP 0 890 943 1/1999

(Continued)

OTHER PUBLICATIONS

PCT International Search Report dated Oct. 4, 2005.

(Continued)

*Primary Examiner*—Qi Han
(74) *Attorney, Agent, or Firm*—Dickinson Wright PLLC

(57) ABSTRACT

There is disclosed an audio encoding device capable of realizing effective encoding while using audio encoding of the CELP method in an extended layer when hierarchically encoding an audio signal. In this device, a first encoding section (115) subjects an input signal (S11) to audio encoding processing of the CELP method and outputs the obtained first encoded information (S12) to a parameter decoding section (120). The parameter decoding section (120) acquires a first quantization LSP code (L1), a first adaptive excitation lag code (A1), and the like from the first encoded information (S12), obtains a first parameter group (S13) from these codes, and outputs it to a second encoding section (130). The second encoding section (130) subjects the input signal (S11) to a second encoding processing by using the first parameter group (S13) and obtains second encoded information (S14). A multiplexing section (154) multiplexes the first encoded information (S12) with the second encoded information (S14) and outputs them via a transmission path N to a decoding apparatus (150).

11 Claims, 14 Drawing Sheets

U.S. PATENT DOCUMENTS

| | | | | |
|---|---|---|---|---|
| 6,192,334 | B1 | 2/2001 | Nomura | |
| 6,208,957 | B1 | 3/2001 | Nomura | |
| 6,735,567 | B2 * | 5/2004 | Gao et al. | 704/258 |
| 6,804,639 | B1 | 10/2004 | Ehara | |
| 2002/0111800 | A1 | 8/2002 | Suzuki et al. | |
| 2003/0154073 | A1 | 8/2003 | Ota et al. | |
| 2003/0177004 | A1 * | 9/2003 | Jabri et al. | 704/219 |

FOREIGN PATENT DOCUMENTS

| | | |
|---|---|---|
| JP | 8179795 | 7/1996 |
| JP | 10097295 | 4/1998 |
| JP | 10282997 | 10/1998 |
| JP | 1130997 | 2/1999 |
| JP | 2000132197 | 5/2000 |
| JP | 200273097 | 3/2002 |
| JP | 2003295879 | 10/2003 |
| JP | 200494132 | 3/2004 |
| WO | 0120595 | 3/2001 |

OTHER PUBLICATIONS

M. R. Schroeder, et al.; "Code-Excited Linear Prediction (CELP): High-Quality Speech at Very Low Bit Rates," IEEE proc., ICASSP, 1985, pp. 937-940.

European Search Report dated Feb. 19, 2009.

* cited by examiner

AUDIO ENCODING DEVICE, AUDIO DECODING DEVICE, AND METHOD THEREOF

TECHNICAL FIELD

The present invention relates to a speech encoding apparatus that hierarchically encodes a speech signal, a speech decoding apparatus that hierarchically decodes encoded information generated by the speech encoding apparatus, and a method thereof.

BACKGROUND ART

In communication systems handling digitized speech/sound signals, such as mobile communication or the Internet communication, speech/sound signal encoding/decoding techniques are essential for effective use of a communication line that is a limited resource, and many encoding/decoding schemes have so far been developed.

Among these, particularly a CELP encoding and decoding scheme is put in practical use as a mainstream scheme (see, for example, Non-Patent Document 1). The CELP scheme speech encoding apparatus encodes input speech based on a speech generation model. Specifically, a digital speech signal is separated into frames of approximately 20 ms, linear prediction analysis of the speech signals is performed per frame, and the obtained linear prediction coefficients and linear prediction residual vectors are encoded individually.

In communication systems where packets are transmitted, such as Internet communication, packet loss may occur depending on the network state, and a function is desired where speech and sound can be decoded using the remaining encoded information, even if part of encoded information is lost. Similarly, also in variable rate communication systems where a bit rate varies depending on line capacity, when the line capacity decreases, it is desirable to reduce the burden on communication system by transmitting a part of encoded information. As a technique of capable of decoding the original data using all or part of encoded information, a scalable encoding technique has lately attracted attention. Several scalable encoding schemes have been conventionally disclosed (see, for example, Patent Document 1).

A scalable encoding scheme generally consists of a base layer and a plurality of enhancement layers, and these layers form a hierarchical structure in which the base layer is the lowest layer. Encoding of each layer is performed by taking a residual signal, which is a signal representing a difference between an input signal of the lower layer and a decoded signal, as a target for encoding, and using encoded information at lower layers. This configuration enables the original data decoding using encoded information of all layers or only encoded information at lower layers.

Patent Document 1: Japanese Patent Application Laid-Open No. HEI10-97295

Non-Patent Document 1: Manfred R. Schroeder, Bishnu S. Atal, "CODE-EXCITED LINER PREDICTION (CELP): HIGH-QUALITY SPEECH AT VERY LOW BIT RAYES," IEEE proc., ICASSP'85 pp.937-940

DISCLOSURE OF INVENTION

Problems to be Solved by the Invention

However, when scalable encoding on a speech signal is considered, in the conventional method, the target for encoding in an enhancement layer is a residual signal. This residual signal is a differential signal between the input signal of the speech encoding apparatus (or a residual signal obtained at the subsequent lower layer) and the decoded signal at the subsequent lower layer, and therefore is a signal where many speech components are lost and many noise components are included. Therefore, in the enhancement layer in the conventional scalable encoding, when an encoding scheme specific to speech encoding such as a CELP scheme for encoding based on a speech generation model is applied, encoding has to be performed based on the speech generation model on the residual signal where many speech components are lost, and it is impossible to encode this signal efficiently. Moreover, encoding the residual signal using an encoding scheme other than CELP abandons an advantage of the CELP scheme capable of obtaining a high-quality decoded signal with lesser bits, and it is not effective.

It is therefore an object of the present invention to provide a speech encoding apparatus capable of implementing, when a speech signal is hierarchically encoded, efficient encoding while using CELP scheme speech encoding in an enhancement layer and obtaining a high-quality decoded signal, a speech decoding apparatus that decodes encoded information generated by this speech encoding apparatus, and a method thereof.

Means for Solving the Problem

A speech encoding apparatus of the present invention adopts a configuration including a first encoding section that generates, from a speech signal, encoded information by CELP scheme speech encoding, a generating section that generates, from the encoded information, a parameter representing a feature of a generation model of the speech signal, and a second encoding section that takes the speech signal as an input and encodes the inputted speech signal by CELP scheme speech encoding using the parameter.

Here, the above parameter means a parameter unique to the CELP scheme used in CELP scheme speech encoding, namely a quantized LSP (Line Spectral Pairs) , an adaptive excitation lag, a fixed excitation vector, a quantized adaptive excitation gain, or a quantized fixed excitation gain.

For example, in the above configuration, the second encoding section adopts a configuration where a difference between an LSP obtained by linear prediction analysis on the speech signal that is an input of the speech encoding apparatus, and a quantized LSP generated by the generating section is encoded using CELP scheme speech encoding. That is, the second encoding section takes the different at the stage of the LSP parameter, and performs CELP scheme speech encoding on this difference, thereby achieving CELP scheme speech encoding that does not take a residual signal as an input.

Here, in the above configuration, the first encoding section and the second encoding section do not restrictively mean first layer (base layer) encoding section and second layer encoding section, respectively, and may mean, for example, second layer encoding section and third layer encoding section, respectively. Also, these sections do not necessarily mean encoding sections for adjacent layers, and may mean, for example, first encoding means as first layer encoding section and second encoding means as third layer encoding section.

Advantageous Effect of the Invention

According to the present invention, when a speech signal is encoded hierarchically, it is possible to implement efficient encoding while using CELP scheme speech encoding in an enhancement layer, and obtain a high-quality decoded signal.

BEST MODE FOR CARRYING OUT THE INVENTION

Embodiments of the present invention will be described in detail below with reference to the accompanying drawings.

Embodiment 1

Figure 1:
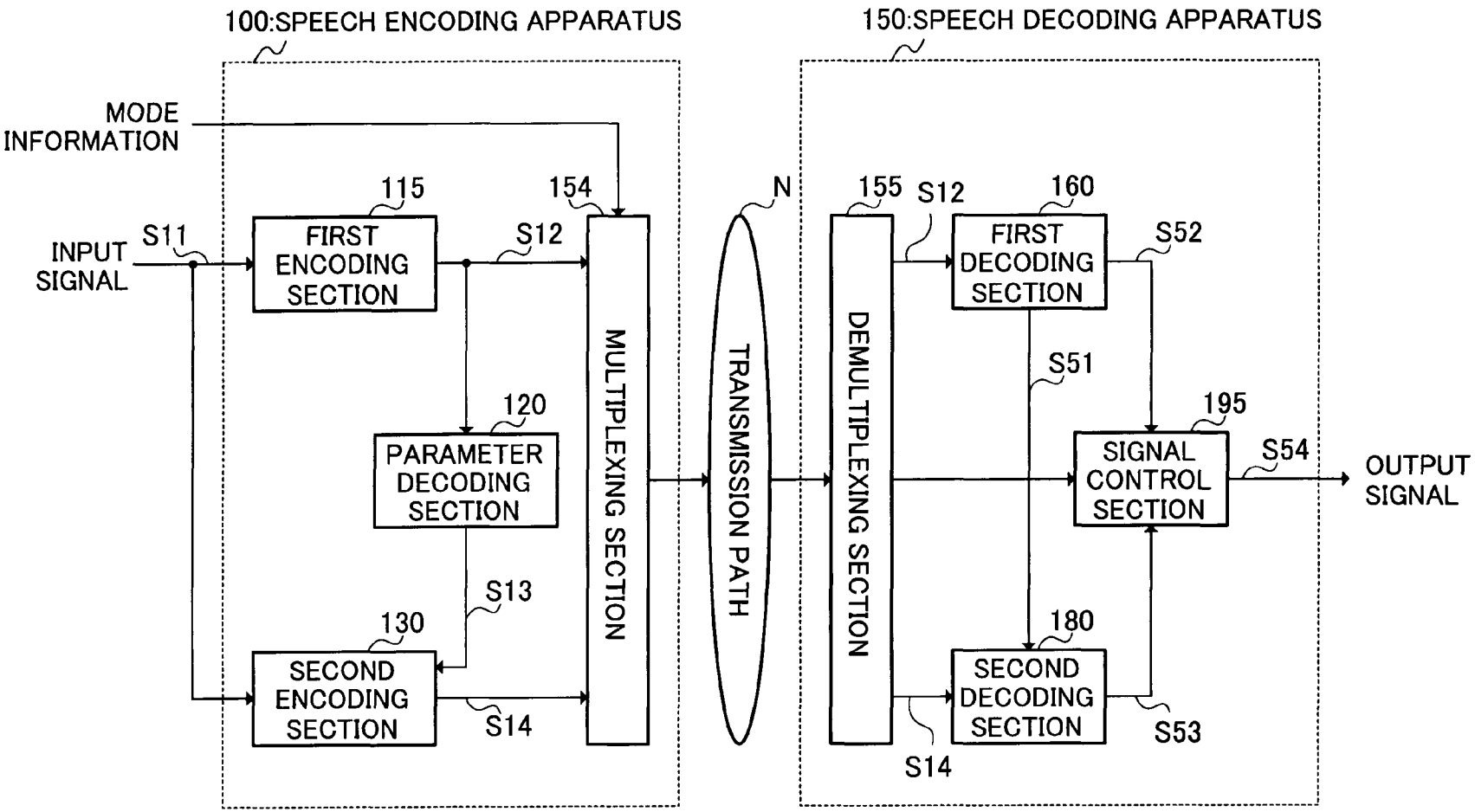
FIG. 1 is a block diagram showing the main configurations of a speech encoding apparatus and a speech decoding apparatus according to Embodiment 1.

FIG. 1 is a block diagram showing the main configurations of speech encoding apparatus 100 and speech decoding apparatus 150 according to Embodiment 1 of the present invention.

In this figure, speech encoding apparatus 100 hierarchically encodes input signal S11 in accordance with an encoding method according to this embodiment, multiplexes obtained hierarchical encoded information S12 and S14, and transmits multiplexed encoded information (multiplexed information) to speech decoding apparatus 150 via transmission path N. On the other hand, speech decoding apparatus 150 demultiplexes the multiplexed information from speech encoding apparatus 100 to encoded information S12 and S14, decodes the encoded information after demultiplexing in accordance with a decoding method according to this embodiment, and outputs output signal S54.

First, speech encoding apparatus 100 will be described in detail.

Figure 2:
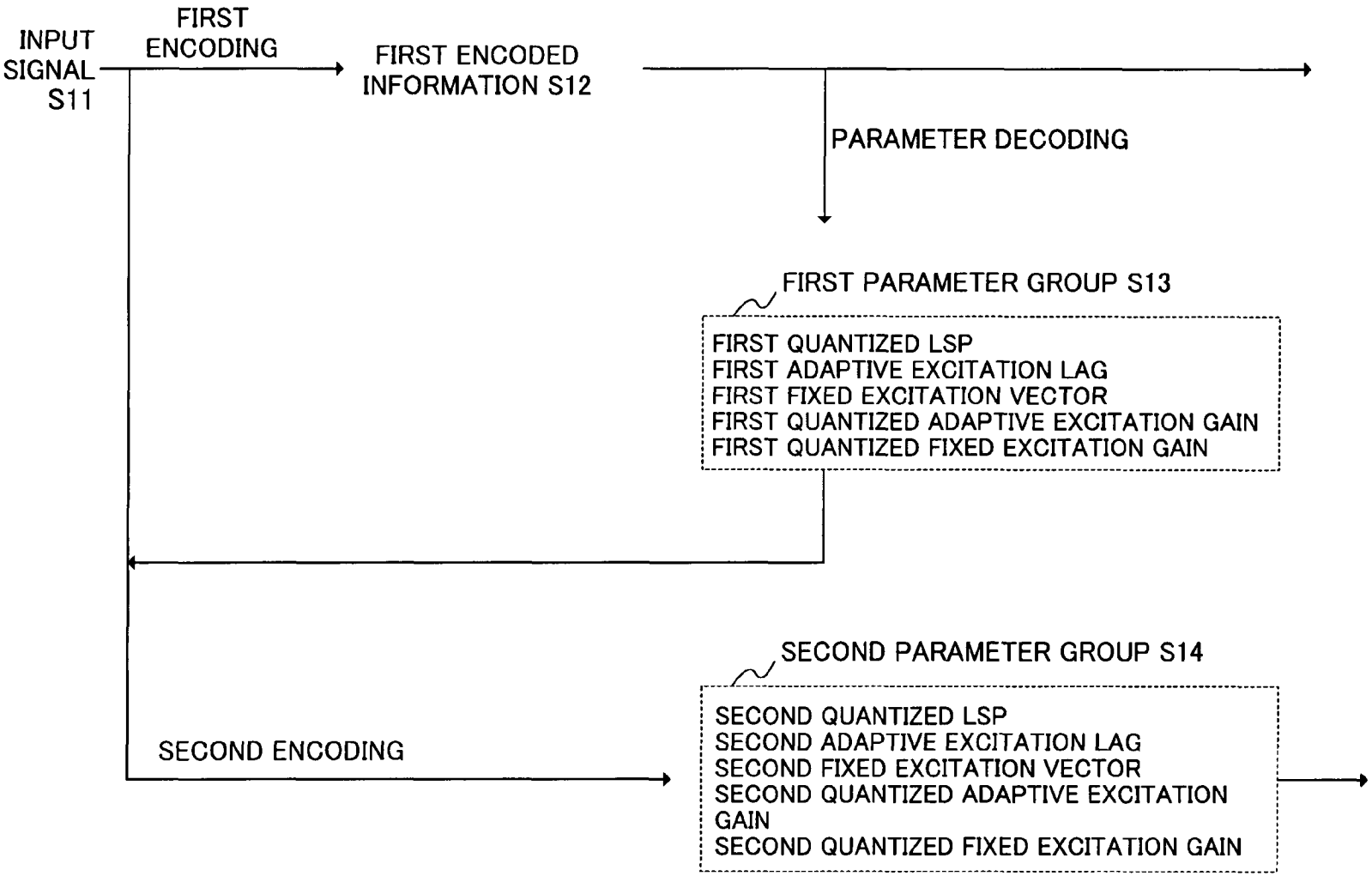
FIG. 2 shows a flow of each parameter in a speech encoding apparatus according to Embodiment 1.

Speech encoding apparatus 100 is mainly composed of first encoding section 115, parameter decoding section 120, second encoding section 130, and multiplexing section 154, and sections perform the following operations. Here, FIG. 2 shows a flow of each parameter in speech encoding apparatus 100 according to Embodiment 1.

First encoding section 115 performs a CELP scheme speech encoding (first encoding) processing on speech signal S11 inputted to speech encoding apparatus 100, and outputs encoded information (first encoded information) S12 representing each parameter obtained based on a generation model of the speech signal to multiplexing section 154. Also, first encoding section 115 also outputs first encoded information S12 to parameter decoding section 120 to perform hierarchical encoding. The parameters obtained by the first encoding processing are hereinafter referred to as a first parameter group. Specifically, the first parameter group includes a first quantized LSP (Line Spectral Pairs), a first adaptive excitation lag, a first fixed excitation vector, a first quantized adaptive excitation gain, and a first quantized fixed excitation gain.

Parameter decoding section 120 performs parameter decoding on first encoded information S12 outputted from first encoding section 115, and generates parameters representing a feature of the generation mode of the speech signal. In this parameter decoding, encoded information is not completely decoded, but partially decoded, thereby obtaining the above-described first parameter group. That is, while it is an object of the conventional decoding processing to obtain the original signal before encoding by decoding encoded information, it is an object of the parameter decoding processing to obtain the first parameter group. Specifically, the parameter decoding section 120 demultiplexes first encoded information S12, and obtains a first quantized LSP code (L1) , a first adaptive excitation lag code (A1) a first quantized adaptive excitation gain code (G1), and a first fixed excitation vector gain (F1) , and obtains a first parameter group S13 from each of the obtained codes. This first parameter group S13 is outputted to second encoding section 130.

Second encoding section 130 obtains a second parameter group by performing second encoding processing which will be described later, using the input signal S11 of speech encoding apparatus 100 and the first parameter group S13 outputted from parameter decoding section 120, and outputs encoded information (second encoded information) S14 representing this second parameter group to multiplexing section 154. Here, the second parameter group includes a second quantized LSP, a second adaptive excitation lag, a second fixed excitation vector, a second quantized adaptive excitation gain, and a second quantized fixed excitation gain each corresponding to those of the first parameter group.

The first encoded information S12 is inputted to multiplexing section 154 from first encoding section 115, and also the second encoded information S14 is inputted from second encoding section 130. Multiplexing section 154 selects necessary encoded information in accordance with mode information of the speech signal inputted to speech encoding apparatus 100, multiplexes the selected encoded information and the mode information, and generates the multiplexed encoded information (multiplexed information). Here, the mode information is information that indicates encoded information to be multiplexed and transmitted. For example, when the mode information is "0", multiplexing section 154 multiplexes the first encoded information S12 and the mode information, and when the mode information is "1", multiplexing section 154 multiplexes the first encoded information S12, the second encoded information S14, and the mode information. As described above, by changing a value of the mode information, a combination of encoded information to be transmitted to speech decoding apparatus 150 can be changed. Next, multiplexing section 154 outputs the multiplexed information after multiplexing to speech decoding apparatus 150 via the transmission path N.

As described above, this embodiment is characterized by the operations of parameter decoding section 120 and second encoding section 130. For convenience of description, processing of sections will be described in detail in the order of first encoding section 115, parameter decoding section 120, and then second encoding section 130.

Figure 3:
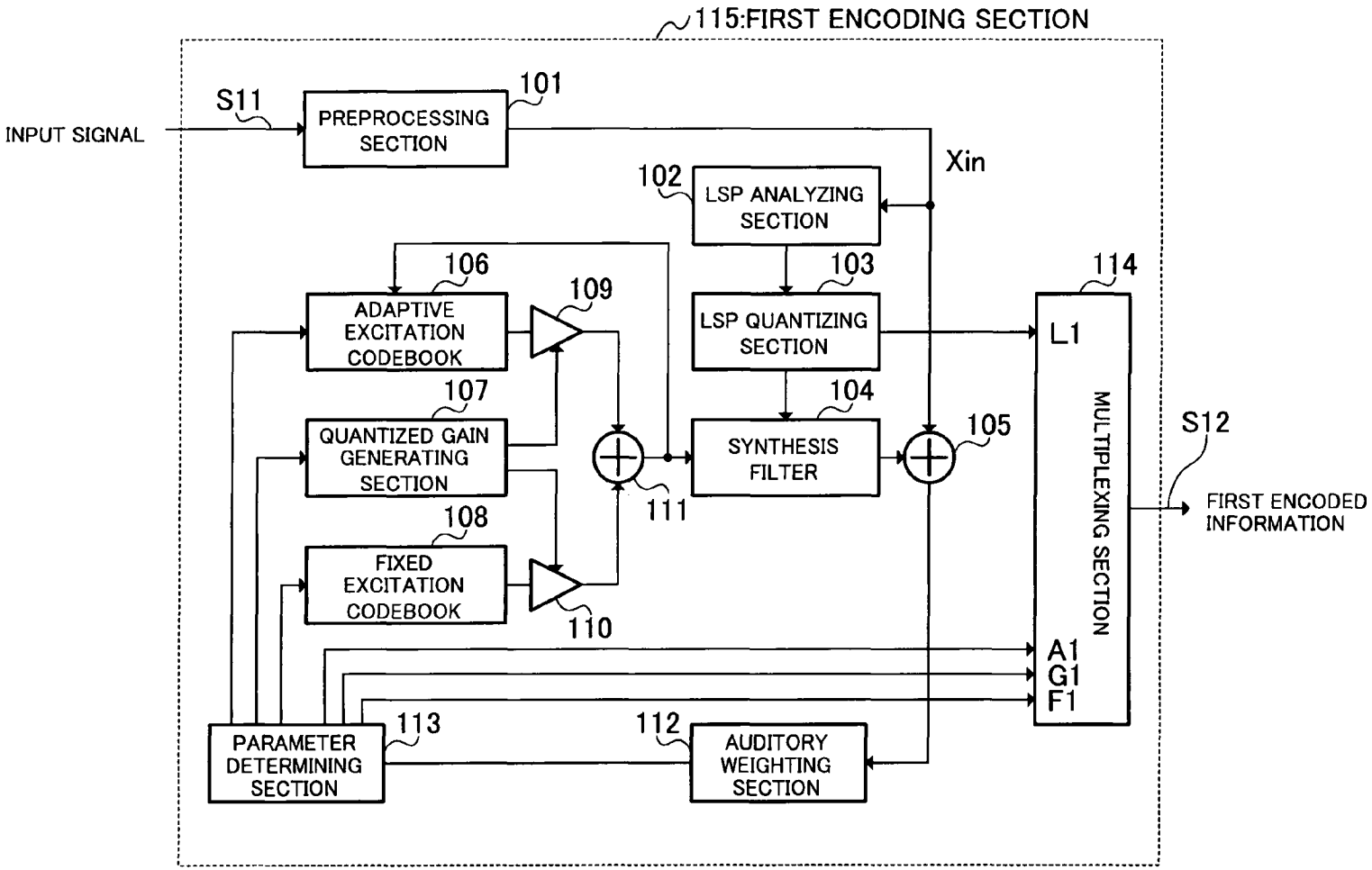
FIG. 3 is a block diagram showing an internal configuration of a first encoding section according to Embodiment 1.

FIG. 3 is a block diagram showing an internal configuration of first encoding section 115.

Preprocessing section 101 performs, on the speech signal S11 inputted to speech encoding apparatus 100, high-pass filter processing of removing DC components and waveform shaping processing and pre-emphasis processing which help to improve the performance of subsequent encoding processing, and outputs the processed signal (Xin) to LSP analyzing section 102 and adder 105.

LSP analyzing section 102 performs linear prediction analysis using the Xin, converts LPC (Linear Prediction Coefficients) resulting from the analysis into LSP, and outputs the conversion result as a first LPC to LSP quantizing section 103.

LSP quantizing section 103 quantizes the first LSP outputted from LSP analyzing section 102 using quantizing processing which will be described later, and outputs a quantized first LSP (first quantized LSP) to synthesis filter 104. Also, LSP quantizing section 103 outputs a first quantized LSP code (L1) representing the first quantized LSP to multiplexing section 114.

Synthesis filter 104 performs filer synthesis of a driving excitation outputted from adder 111 using a filter coefficient based on the first quantized LSP, and generates a synthesis signal. The synthesis signal is outputted to adder 105.

Adder 105 reverses the polarity of the synthesis signal, adds this signal to Xin, thereby calculating an error signal, and outputs this calculated error signal to auditory weighting section 112.

Adaptive excitation codebook 106 has a buffer storing driving excitations which have been previously outputted from adder 111. Also, based on an extraction position specified by a signal outputted from parameter determining section 113, adaptive excitation codebook 106 extracts a set of samples for one frame from the buffer at the extraction position, and outputs the sample set as a first adaptive excitation vector to multiplier 109. Further, adaptive excitation codebook 106 updates the above buffer, each time a driving excitation is inputted from adder 111.

Quantized gain generating section 107 determines, based on an instruction from parameter determining section 113, a first quantized adaptive excitation gain and a first quantized fixed excitation gain, and outputs the first quantized adaptive excitation gain to multiplier 109 and the first quantized fixed excitation gain to multiplier 110.

Fixed excitation codebook 108 outputs a vector having a form specified by the instruction from parameter determining section 113 as a first fixed excitation vector to multiplier 110.

Multiplier 109 multiplies the first quantized adaptive excitation gain outputted from quantized gain generating section 107 by the first adaptive excitation vector outputted from adaptive excitation codebook 106, and outputs the result to adder 111. Multiplier 110 multiplies the first quantized fixed excitation gain output from quantized gain generating section 107 by the first fixed excitation vector outputted from fixed excitation codebook 108 and outputs the result to adder 111.

Adder 111 adds the first adaptive excitation vector multiplied by the gain at multiplier 109 and the first fixed excitation vector multiplied by the gain at multiplier 110, and outputs a driving excitation resulting from the addition to synthesis filter 104 and adaptive excitation codebook 106. The driving excitation inputted to adaptive excitation codebook 106 is stored into the buffer.

Auditory weighting section 112 applies an auditory weight to the error signal outputted from adder 105 and outputs a result as an encoding distortion to parameter determining section 113.

Parameter determining section 113 selects a first adaptive excitation lag that minimizes the encoding distortion outputted from auditory weighting section 112, and outputs a first adaptive excitation lag code (A1) indicating a selected lag to multiplexing section 114. Also, parameter determining section 113 selects a first fixed excitation vector that minimizes the encoding distortion outputted from auditory weighting section 112, and outputs a first fixed excitation vector code (F1) indicating a selected vector to multiplexing section 114. Further, parameter determining section 113 selects a first quantized adaptive excitation gain and a first quantized fixed excitation gain that minimize the encoding distortion outputted from auditory weighting section 112, and outputs a first quantized excitation gain code (G1) indicating selected gains to multiplexing section 114.

Multiplexing section 114 multiplexes the first quantized LSP code (L1) outputted from LSP quantizing section 103 and the first adaptive excitation lag code (A1), the first fixed excitation vector code (F1), and the first quantized excitation gain code (G1) outputted from parameter determining section 113, and outputs the result as the first encoded information S12.

Figure 4:
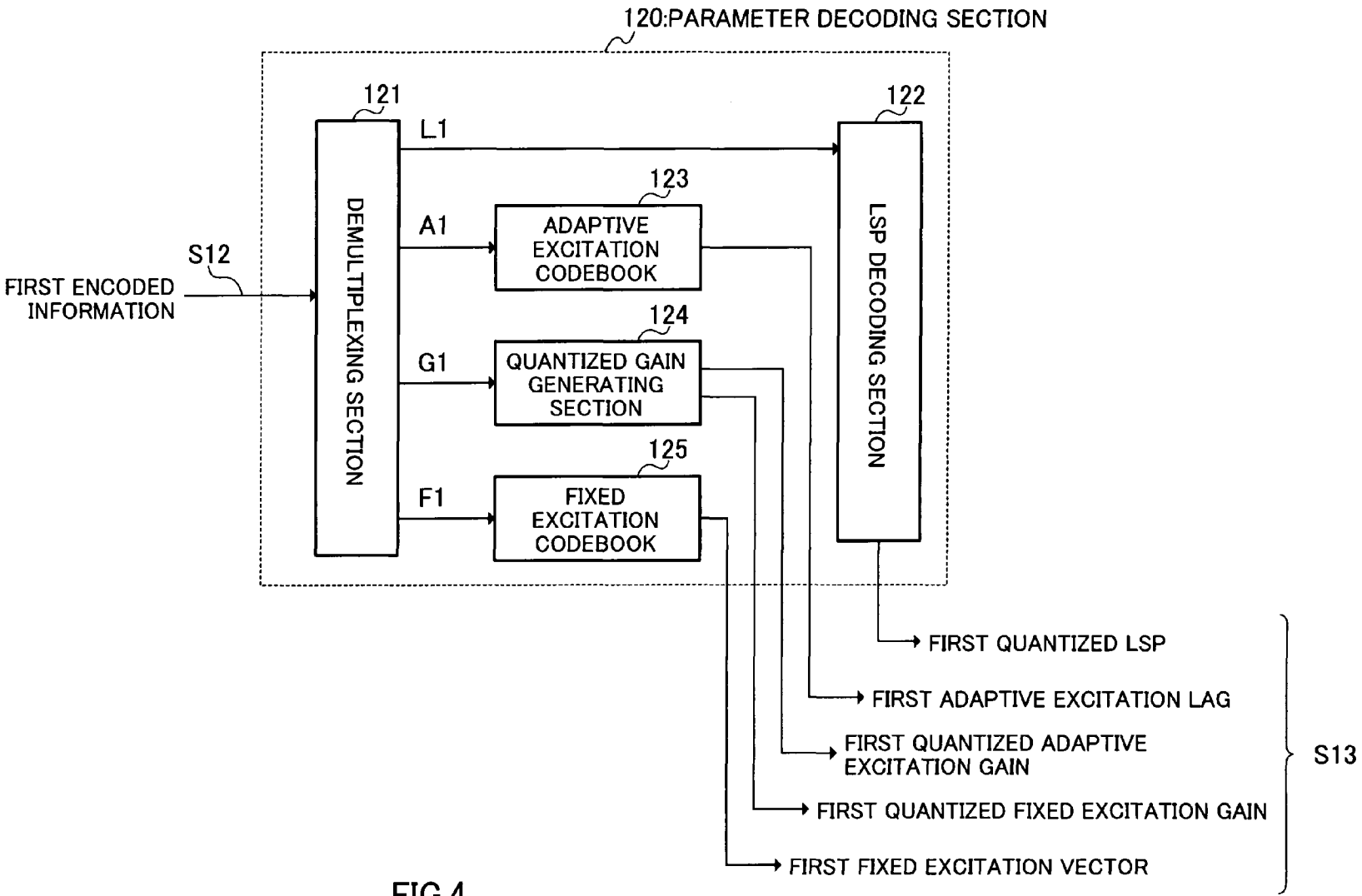
FIG. 4 is a block diagram showing an internal configuration of a parameter decoding section according to Embodiment 1.

FIG. 4 is a block diagram showing an internal configuration of parameter decoding section 120.

Demultiplexing section 121 demultiplexes the first encoded information S12 outputted from first encoding section 115 into individual codes (L1, A1, G1, and F1) ,and output codes to each component. Specifically, the first quantized LSP code (L1) demultiplexed from the first encoded information S12 is outputted to LSP decoding section 122, the first adaptive excitation lag code (A1) demultiplexed as well is outputted to adaptive excitation codebook 123, the first quantized excitation gain code (G1) demultiplexed as well is outputted to quantized gain generating section 124, and the first fixed excitation vector code (F1) demultiplexed as well is outputted to fixed excitation codebook 125.

LSP decoding section 122 decodes the first quantized LSP code (L1) outputted from demultiplexing section 121 to a first quantized LSP, and outputs the decoded first quantized LSP to second encoding section 130.

Adaptive excitation codebook 123 decodes an extraction position specified by the first adaptive excitation lag code (A1) as a first adaptive excitation lag. Then, adaptive excitation codebook 123 outputs the obtained first adaptive excitation lag to second encoding section 130.

Quantized gain generating section 124 decodes the first quantized adaptive excitation gain and the first quantized fixed excitation gain specified by the first quantized excitation gain code (G1) outputted from demultiplexing section 121. Then, quantized gain generating section 124 outputs the obtained first quantized adaptive excitation gain to second encoding section 130, and also the first quantized fixed excitation gain to second encoding section 130.

Fixed excitation codebook 125 generates a first fixed excitation vector specified by the first fixed excitation vector code (F1) outputted from demultiplexing section 121, and outputs the vector to second encoding section 130.

The above-described first quantized LSP, first adaptive excitation lag, first fixed excitation vector, first quantized adaptive excitation gain, and first quantized fixed excitation gain are outputted as the first parameter group S13 to second encoding section 130.

Figure 5:
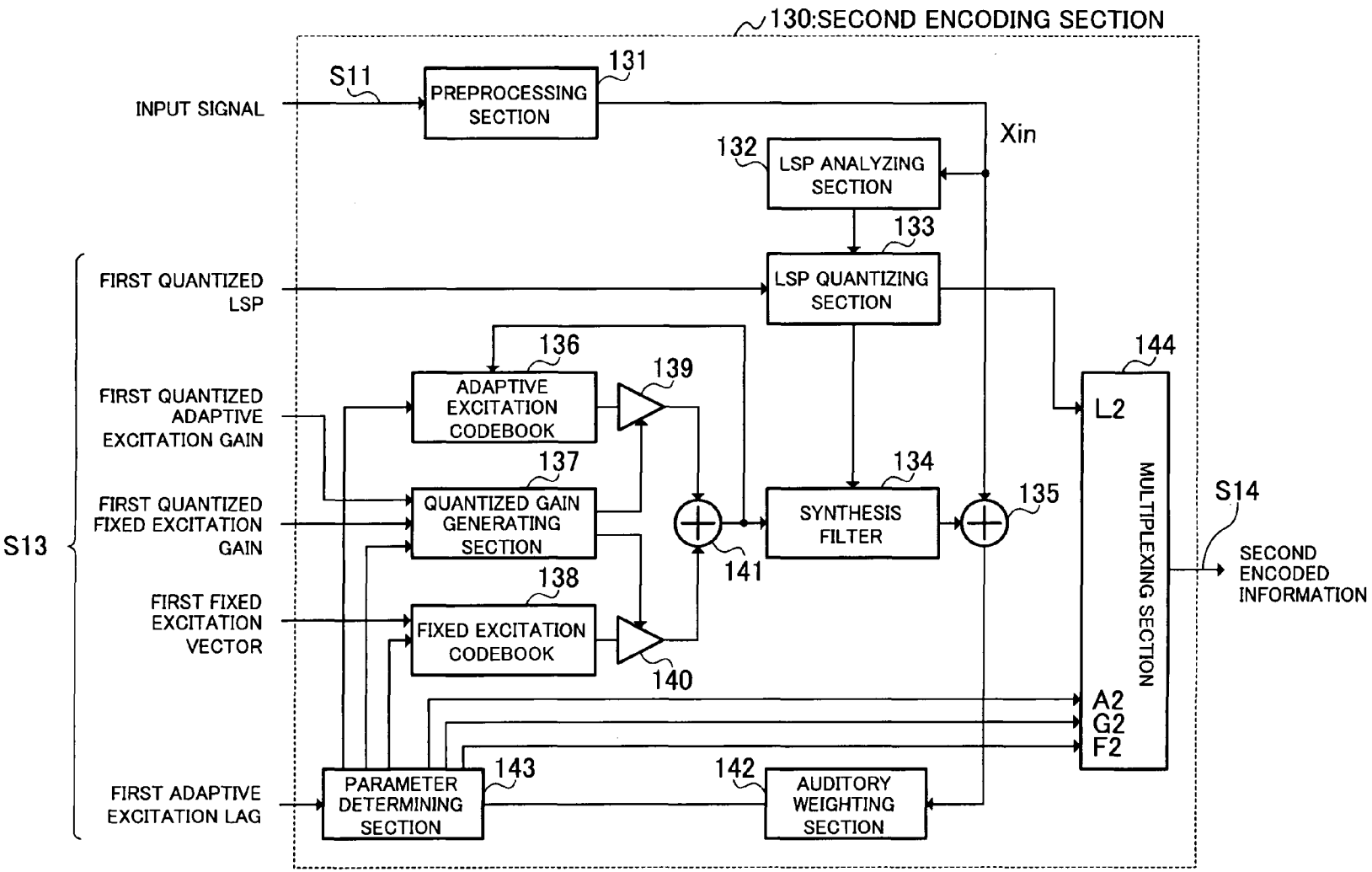
FIG. 5 is a block diagram showing an internal configuration of a second encoding section according to Embodiment 1.

FIG. 5 is a block diagram showing an internal configuration of second encoding section 130.

Preprocessing section 131 performs, on the speech signal S11 inputted to speech encoding apparatus 100, high-pass filter processing of removing DC components and waveform shaping processing and pre-emphasis processing which help to improve the performance of subsequent encoding processing, and outputs the processed signal (Xin) to LSP analyzing section 132 and adder 135.

LSP analyzing section 132 performs linear prediction analysis using the Xin, converts LPC (Linear Prediction Coefficients) resulting from the analysis into LSP (Line Spectral Pairs), and outputs the conversion result as a second LSP to LSP quantizing section 133.

LSP quantizing section 133 reverses the polarity of the first quantized LSP outputted from parameter decoding section 120, adds the first quantized LSP after polarity reversion to the second LSP outputted from LSP analyzing section 132 and thereby calculating a residual LSP. Next, LSP quantizing section 133 quantizes the calculated residual LSP using quantizing processing which will be described later, adds the quantized residual LSP (quantized residual LSP) and the first quantized LSP outputted from parameter decoding section 120, and thereby calculating a second quantized LSP. This second quantized LSP is outputted to synthesis filter 134, while the second quantized LSP code (L2) representing the quantized residual LSP is outputted to multiplexing section 144.

Synthesis filter 134 performs filter synthesis of a driving excitation, outputted from adder 141, by a filter coefficient based on the second quantized LSP, and thereby generates a synthesis signal. The synthesis signal is outputted to adder 135.

Adder 135 reverses the polarity of the synthesis signal, adds this signal to Xin, thereby calculating an error signal, and outputs this calculated error signal to auditory weighting section 142.

Adaptive excitation codebook 136 has a buffer storing driving excitations which have been previously outputted from adder 141. Also, based on an extraction position specified by the first adaptive excitation lag and a signal outputted from parameter determining section 143, adaptive excitation codebook 136 extracts a set of samples for one frame from the buffer at the extraction position, and outputs the sample set as a second adaptive excitation vector to multiplier 139. Further, adaptive excitation codebook 136 updates the above buffer, each time a driving excitation is inputted from adder 141.

Quantized gain generating section 137 obtains, based on an instruction from parameter determining section 143, a second quantized adaptive excitation gain and a second quantized fixed excitation gain using the first quantized adaptive excitation gain and the first quantized fixed excitation gain outputted from parameter decoding section 120. The second quantized adaptive excitation gain is outputted to multiplier 139, and the second quantized fixed excitation gain is outputted to multiplier 140.

Fixed excitation codebook 138 obtains a second fixed excitation vector by adding a vector having a form specified by the indication from parameter determining section 143 and the first fixed excitation vector outputted from parameter decoding section 120, and outputs the result to multiplier 140.

Multiplier 139 multiplies the second adaptive excitation vector outputted from adaptive excitation codebook 136 by the second quantized adaptive excitation gain outputted from quantized gain generating section 137, and outputs the result to adder 141. Multiplier 140 multiplies the second fixed excitation vector outputted from fixed excitation codebook 138 by the second quantized fixed excitation gain outputted from quantized gain generating section 137, and outputs the result to adder 141. Adder 141 adds the second adaptive excitation vector multiplied by the gain at multiplier 139 and the second fixed excitation vector multiplied by the gain at multiplier 140, and outputs a driving excitation resulting from the addition to synthesis filter 134 and adaptive excitation codebook 136. The driving excitation inputted to adaptive excitation codebook 136 is stored into the buffer.

Auditory weighting section 142 applies an auditory weighting to the error signal outputted from adder 135, and outputs a result as encoding distortion to parameter determining section 143.

Parameter determining section 143 selects a second adaptive excitation lag that minimizes the encoding distortion output from auditory weighting section 142, and outputs a second adaptive excitation lag code (A2) indicating the a selected lag to multiplexing section 144. Also, parameter determining section 143 selects a second fixed excitation vector that minimizes the encoding distortion outputted from auditory weighting section 142 using the first adaptive excitation lag outputted from parameter decoding section 120, and outputs a second fixed excitation vector code (F2) indicating a selected vector to multiplexing section 144. Further, parameter determining section 143 selects a second quantized adaptive excitation gain and a second quantized fixed excitation gain that minimizes the encoding distortion outputted from auditory weighting section 142, and outputs a second quantized excitation gain code (G2) indicating a selected gain to multiplexing section 144.

Multiplexing section 144 multiplexes the second quantized LSP code (L2) outputted from LSP quantizing section 133 and the second adaptive excitation lag code (A2), the second fixed excitation vector code (F2), and the second quantized excitation gain code (G2) outputted from parameter determining section 143, outputs the result as the second encoded information S14.

Next, processing will be described where LSP quantizing section 133 shown in FIG. 5 determines a second quantized LSP. Here, an example will be described where the number of bits assigned to the second quantized LSP code (L2) is "8" and the residual LSP is vector-quantized.

LSP quantizing section 133 is provided with second LSP codebook in which 256 variants of second LSP code vectors $[lSp_{res}^{(L2')}(i)]$ created in advance are stored. Here, L2' is an index attached to the second LSP code vector, and takes any value of 0 to 255. Also, $lsp_{res}^{(L2')}(i)$ is an N-dimensional vector, and i takes a value from 0 to N−1.

A second LSP $[\alpha_2(i)]$ is inputted to LSP quantizing section 133 from LSP analyzing section 132. Here, $\alpha_2$ (i) is an N-dimensional vector, and i takes a value from 0 to N−1. A first quantized LSP $[lsp_1^{(L1'min)}(i)]$ is also inputted to LSP quantizing section 133 from parameter decoding section 120. Here, $lsp_1^{(L1'min)}$ (i) is an N-dimensional vector, and i takes a value from 0 to N−1.

LSP quantizing section 133 obtains a residual LSP [res(i)] by the following (Equation 1).

[Equation 1]

$$res(i)=\alpha_2(i)-lsp_1^{(L1'min)}(i)(i=0,\ldots,N-1) \quad \text{(Equation 1)}$$

Next, LSP quantizing section 133 obtains squared error $er_2$ between the residual LSP [res (i) ] and the second LSP code vector [$lsp_{res}^{(L2')}(i)$] by the following (Equation 2).

[Equation 2]

$$er_2=\sum_{i=0}^{N-1}\left(res(i)-lsp_{res}^{(L2')}(i)\right)^2 \quad \text{(Equation 2)}$$

Then, LSP quantizing section 133 obtains a squared error $er_2$ for all L2' and determines a value of L2' (L2'min) that minimizes the squared error $er_2$. The determined L2'min is outputted to multiplexing section 144 as a second quantized LSP code (L2).

Next, LSP quantizing section 133 obtains a second quantized LSP [$lsp_2(i)$] by the following (Equation 3).

[Equation 3]

$$lsp_2(i)=lsp_1^{(L'min)}(i)+lsp_{res}^{(L2'min)}(i)(i=0,\ldots,N-1) \quad \text{(Equation 3)}$$

LSP quantizing section 133 outputs this second quantized LSP [$lsp_2(i)$] to synthesis filter 134.

As described above, [$lsp_2(i)$] obtained by LSP quantizing section 133 is the second quantized LSP, and $lsp_{res}^{(L2'min)}(i)$ that minimizes the squared error $er_2$ is a quantized residual LSP.

Figure 6:
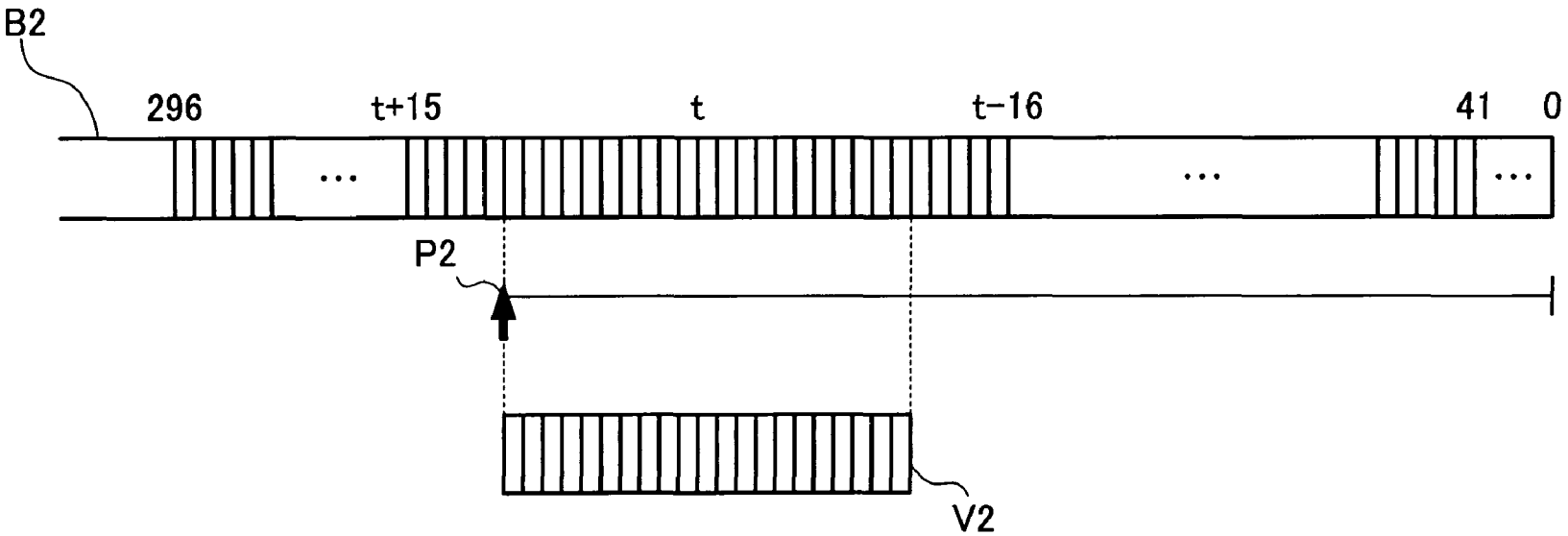
FIG. 6 outlines processing of determining a second adaptive excitation lag.

FIG. 6 outlines processing of determining a second adaptive excitation lag by parameter determining section 143 shown in FIG. 5.

In this figure, a buffer B2 is a buffer provided by adaptive excitation codebook 136, a position P2 is an extraction position of the second adaptive excitation vector, and a vector V2 is extracted second adaptive excitation vector. Also, t represents a first adaptive excitation lag, and values 41 and 296 correspond to a lower limit and an upper limit of the range in which parameter determining section 143 searches for the first adaptive excitation lag. Further, t−16 and t+15 correspond to a lower limit and an upper limit of the range in which the extraction position of the second adaptive excitation vector is shifted.

The range in which the extraction position P2 is shifted is set at a range of a length of 32 (=$2^5$) (for example, t−16 to t+15) , when 5 bits are assigned to the code (A2) representing the second adaptive excitation lag. However, the range in which the extraction position P2 is shifted can be arbitrarily set.

Parameter determining section 143 sets the range in which the extraction position P2 is shifted at t−16 to t+15 with reference to the first adaptive excitation lag t inputted from parameter decoding section 120. Next, parameter determining section 143 shifts the extraction position P2 within the above range and sequentially specifies the extraction position P2 to adaptive excitation codebook 136.

Adaptive excitation codebook 136 extracts the second adaptive excitation vector V2 for the length of the frame from the extraction position P2 specified by parameter determining section 143, and outputs the extracted second adaptive excitation vector V2 to multiplier 139.

Parameter determining section 143 obtains an encoding distortion outputted from auditory weighting section 142 for all second adaptive excitation vectors V2 extracted from all extraction positions P2, and determines an extraction position P2 that minimizes this encoding distortion. The buffer extraction position P2 obtained by the parameter determining section 143 is the second adaptive excitation lag. Parameter determining section 143 encodes a difference (in the example of FIG. 6, −16 to +15) between the first adaptive excitation lag and the second adaptive excitation lag, and outputs the code obtained through encoding to multiplexing section 144 as the second adaptive excitation lag code (A2).

In this manner, with the difference between the first adaptive excitation lag and the second adaptive excitation lag being encoded in second encoding section 130, second decoding section 180 adds the first adaptive excitation lag (t) obtained through the first adaptive excitation lag code and the difference from the second adaptive excitation lag code (−16 to +15), thereby decoding the second adaptive excitation lag (t−16 to t+15).

As described above, parameter determining section 143 receives the first adaptive excitation lag t from parameter decoding section 120, and searches for a range around this t in search for the second adaptive excitation lag, thereby making it possible to quickly find an optimum second adaptive excitation lag.

Figure 7:
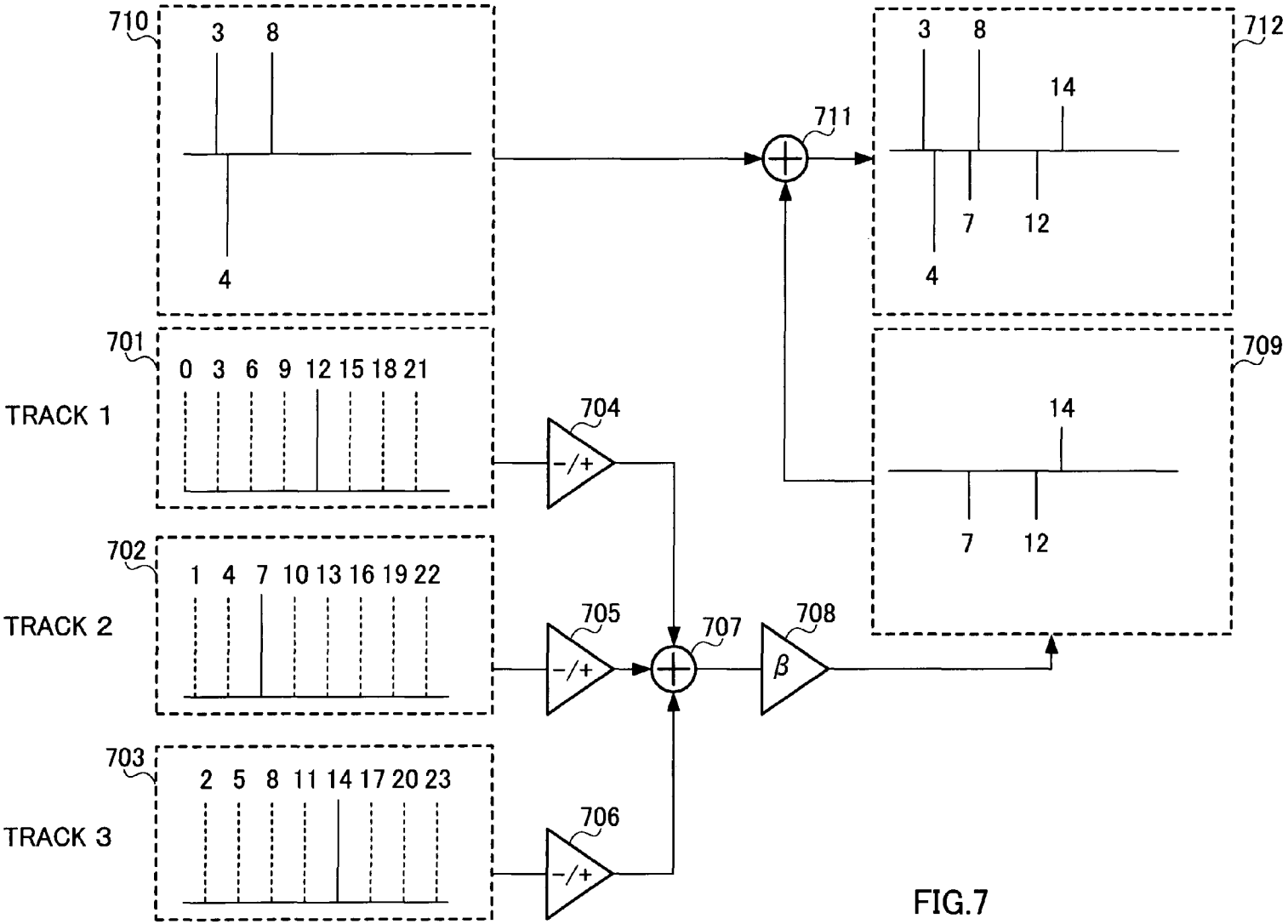
FIG. 7 outlines processing of determining a second fixed excitation vector.

FIG. 7 outlines processing of determining a second fixed excitation vector by the above parameter determining section 143. This figure indicates the process of generating a second fixed excitation vector from algebraic fixed excitation codebook 138.

Track 1, track 2, and track 3 each generate one unit pulse (701, 702, and 703) with an amplitude value of 1 (solid lines in the figure). Each track has different positions where a unit pulse can be generated. In the example of the figure, the tracks are configured such that track 1 raises a unit pulse at any of eight positions {0, 3, 6, 9, 12, 15, 18, 21}, track 2 raises a unit pulse at any of eight positions {1, 4, 7, 10, 13, 16, 19, 22}, and track 3 raises a unit pulse at any of eight positions {2, 5, 8, 11, 14, 17, 20, 23}.

Multiplier 704 applies polarity to the unit pulse generated in track 1. Multiplier 705 applies polarity to the unit pulse generated in track 2. Multiplier 706 applies polarity to the unit pulse generated in track 3. Adder 707 adds the generated three unit pulses together. Multiplier 708 multiplies the added three unit pulses by a predetermined constant β. The constant β is a constant for changing the magnitude of the pulse, and it has been experimentally known that an excellent performance can be obtained when the constant β is set at a value in the order of 0 to 1. Also, the value of the constant β may be set so as to obtain a performance suitable according to the speech encoding apparatus. Adder 711 adds residual fixed excitation vector 709 composed of three pulses and a first fixed excitation vector 710 together, and obtains second fixed excitation vector 712. Here, residual fixed excitation vector 709 is multiplied by the constant β in a range from 0 to 1 and is then added to first fixed excitation vector 710, and as a result, weighting addition with the first fixed excitation vector 710 being weighted is applied.

In this example, unit pulse has eight patterns of positions and two patterns of positions, positive and negative, and three bits for position information and one bit for polarity information are used to represent each unit pulse. Therefore, the fixed excitation codebook has 12 bits in total.

In order to shift generation position of three unit pulses and polarities, parameter determining section 143 sequentially indicates the generation position and polarity to fixed excitation codebook 138.

Fixed excitation codebook 138 configures residual fixed excitation vector 709 using the generation position and polarity indicated by parameter determining section 143, adds the configured residual fixed excitation vector 709 and first fixed excitation vector 710 outputted from parameter decoding section 120 together, and outputs second fixed excitation vector 712 resulting from the addition to multiplier 140.

Parameter determining section 143 obtains an encoding distortion outputted from auditory weighting section 142 for the second fixed excitation vector with respect to all combinations of the generation position and polarity, and determines a combination of the generation position and polarity that minimizes the encoding distortion. Next, parameter determining section 143 outputs the second fixed excitation vector code (F2) representing the determined combination of the generation position and the polarity to multiplexing section 144.

Next, processing will be described where the above parameter determining section 143 carries out an instruction to quantized gain generating section 137, and determines a second quantized adaptive excitation gain and a second quantized fixed excitation gain. Here, a case will be described as an example where 8 bits are assigned to the second quantized excitation gain code (G2)

Quantized gain generating section 137 is provided with a residual excitation gain codebook in which 256 variants of residual excitation gain code vectors $[gain_2^{(K2')}(i)]$ created in advance are stored. Here, K2' is an index attached to the residual excitation gain code vector, and takes any value of 0 to 255. Also, $gain_2^{(K2')}(i)$ is a two-dimensional vector, and i takes a value from 0 to 1.

Parameter determining section 143 indicates a value of K2' from 0 to 255 to quantized gain generating section 137. Quantized gain generating section 137 selects a residual excitation gain code vector $[gain_2^{(K2')}(i)]$ from the residual excitation gain codebook using K2' indicated by parameter determining section 143, obtains a second quantized adaptive excitation gain $[gain_q(0)]$ from the following (Equation 4), and outputs the obtained $gain_q(0)$ to multiplier 139.

[Equation 4]

$$gain_q(0)=gain_1^{(K1'min)}(0)+gain_2^{(K2')}(0) \quad \text{(Equation 4)}$$

Also, quantized gain generating section 137 obtains a second quantized fixed excitation gain $[gain_q(1)]$ from the following (Equation 5), and outputs the obtained $gain_q(1)$ to multiplier 140.

[Equation 5]

$$gain_q(1)=gain_1^{(K1'min)}(1)+gain_2^{(K2')}(1) \quad \text{(Equation 5)}$$

Here, $gain_1^{(k1'min)}(0)$ represents a first quantized adaptive excitation gain, and $gain_1^{(k1'min)}(1)$ represents a first quantized fixed excitation gain, each being outputted from parameter decoding section 120.

As described above, $gain_q(0)$ obtained by quantized gain generating section 137 represents a second quantized adaptive excitation gain, and $gain_q(1)$ is a second quantized fixed excitation gain.

Parameter determining section 143 obtains an encoding distortion outputted from auditory weighting section 142 for all K2', and determines a value of K2' (K2'min) that minimizes the encoding distortion. Next, parameter determining section 143 outputs the determined K2'min to multiplexing section 144 as a second quantized excitation gain code (G2).

As described above, according to the speech encoding apparatus of this embodiment, by taking the input signal of the speech encoding apparatus as a target for encoding by second encoding section 130, CELP scheme speech encoding suitable for encoding a speech signal can be effectively applied, thereby obtaining decoded signal with good quality. Also, second encoding section 130 encodes the input signal using the first parameter group and generates a second parameter group, the decoding apparatus side can generate a second decoded signal using two parameter groups (the first parameter group and the second parameter group).

Also, in the above configuration, parameter decoding section 120 partially decodes the first encoded information S12 inputted from first encoding section 115 and outputs each obtained parameter to second encoding section 130 corresponding to an upper layer of first encoding section 115, and second encoding section 130 performs second encoding using each of these parameters and the input signal of speech encoding apparatus 100. By adopting the above configuration, when the speech signal is hierarchically encoded, the speech encoding apparatus according to the present embodiment can achieve efficient encoding while using CELP scheme speech encoding in an enhancement layer, and can obtain decoded signal with good quality. Further, it is not necessary for the first encoded information to be completely decoded, so that it is possible to reduce the amount of process operations in encoding.

Moreover, in the above configuration, second encoding section 130 encodes, by CELP scheme speech encoding, a difference between an LSP obtained by a linear prediction analysis on the speech signal that is the input of speech encoding apparatus 100 and a quantized LSP generated by parameter decoding section 120. That is, second encoding section 130 takes a difference at the stage of the LSP parameter, and performs CELP scheme speech encoding on this difference, thereby achieving CELP scheme speech encoding that does not take a residual signal as an input.

Furthermore, in the above configuration, the second encoded information S14 outputted from (second encoding section 130 of) speech encoding apparatus 100 is a totally new signal not generated from any conventional speech encoding apparatus.

Next, supplemental description will be given to the operation of first encoding section 115 shown in FIG. 3.

The following describes processing of determining a first quantized LSP by LSP quantizing section 103 in first encoding section 115.

Here, description will be made with an example where 8 bits are assigned to the first quantized LSP code (L1), and the first LSP is vector-quantized.

LSP quantizing section 103 is provided with a first LSP codebook in which 256 variants of first LSP code vectors $[lsp_1^{(L1')}(i)]$ created in advance are stored. Here, L1' is an index attached to the first LSP code vector, and takes any value of 0 to 255. Also, $lsp_1^{(L1')}(i)$ is an N-dimensional vector, and i takes a value from 0 to N−1.

A first LSP $[\alpha_1(i)]$ is inputted to LSP quantizing section 103 from LSP analyzing section 102. Here, $\alpha_1(i)$ is an N-dimensional vector, and i takes a value from 0 to N−1.

LSP quantizing section 103 obtains a squared error $er_1$ between the first LSP $[\alpha_1(i)]$ and the first LSP code vector $[lsp_1^{(L1'min)}(i)]$ from the following (Equation 6).

[Equation 6]

$$er_1 = \sum_{i=0}^{N-1} \left(\alpha_1(i) - lsp_1^{(L1')}(i)\right)^2 \quad \text{(Equation 6)}$$

Next, LSP quantizing section 103 obtains a squared error $er_1$ for all L1' to determine a value of L1' (L1'min) that minimizes the squared error $er_1$. Then, LSP quantizing section 103 outputs this determined L1'min to multiplexing section 114 as a first quantized LSP code (L1), and also outputs $lsp_1^{(L1'min)}$ (i) to synthesis filter 104 as a first quantized LSP.

As described above, $lsp_1^{(L1'min)}$ (i) obtained by LSP quantizing section 103 is the first quantized LSP.

Figure 8:
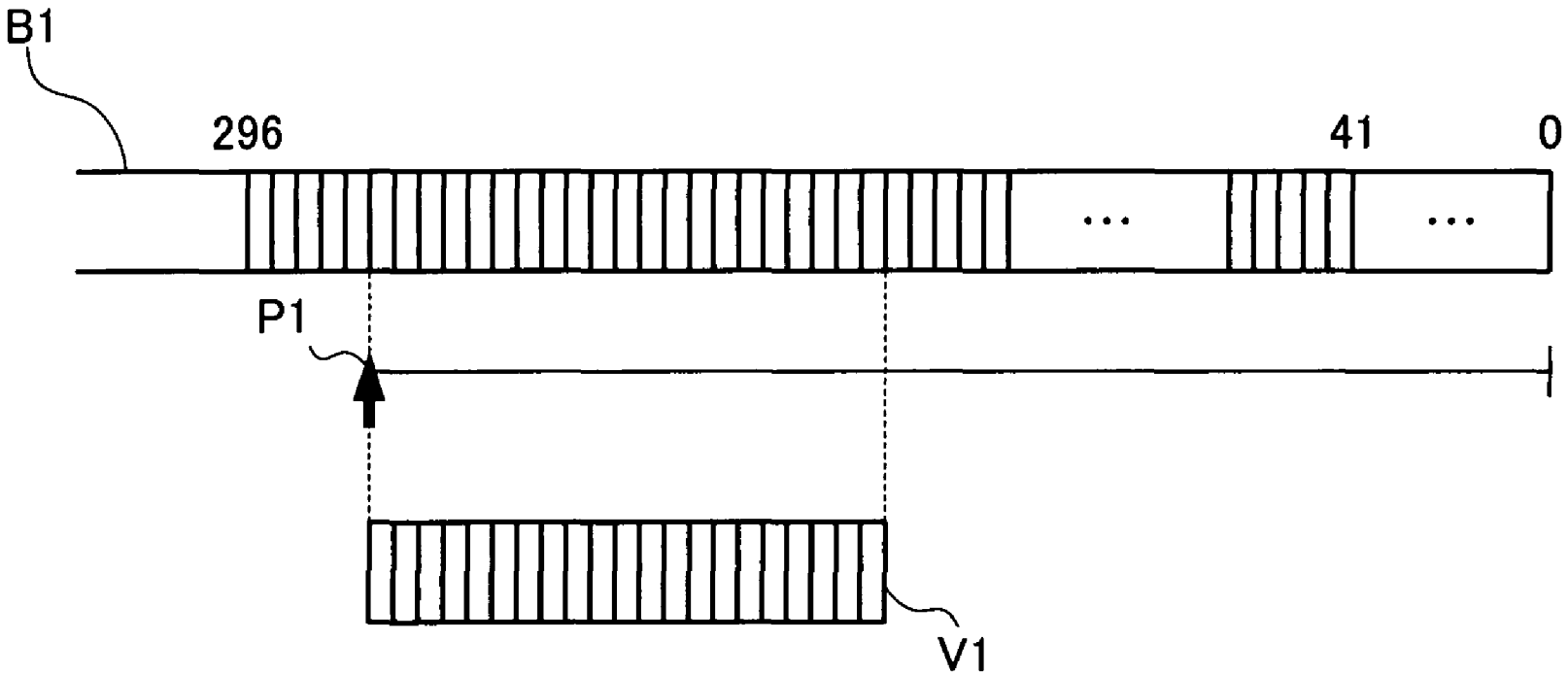
FIG. 8 outlines processing of determining a first adaptive excitation lag.

FIG. 8 outlines processing of determining a first adaptive excitation lag by parameter determining section 113 in first encoding section 115.

In this figure, a buffer B1 is a buffer provided by adaptive excitation codebook 106, a position P1 is an extraction position of the first adaptive excitation vector, and a vector V1 is an extracted first adaptive excitation vector. Also, values 41 and 296 correspond to lower and upper limits of the range of shifting extraction position P1.

Assuming that that 8 bits are assigned to the code (A1) indicating the first adaptive excitation lag, the range of shifting the extraction position P1 is set in a range of length of 256 ($=2^8$) (for example, 41 to 296). However, the range of shifting the extraction position P1 can be arbitrarily set.

Parameter determining section 113 shifts the extraction position P1 within the set range, and sequentially indicates the extraction position P1 to adaptive excitation codebook 106.

Adaptive excitation codebook 106 extracts the first adaptive excitation vector V1 with a length of the frame by the extraction position P1 indicated from parameter determining section 113, and outputs the extracted first adaptive excitation vector to multiplier 109.

Parameter determining section 113 obtains the encoding distortion outputted from auditory weighting section 112 for all first adaptive excitation vectors V1 extracted from all extraction positions P1, and determines an extraction position P1 that minimizes the encoding distortion. Extraction position P1 from buffer obtained by parameter determining section 113 is the first adaptive excitation lag. Parameter determining section 113 outputs the first adaptive excitation lag code (A1) indicating the first adaptive excitation lag to multiplexing section 114.

Figure 9:
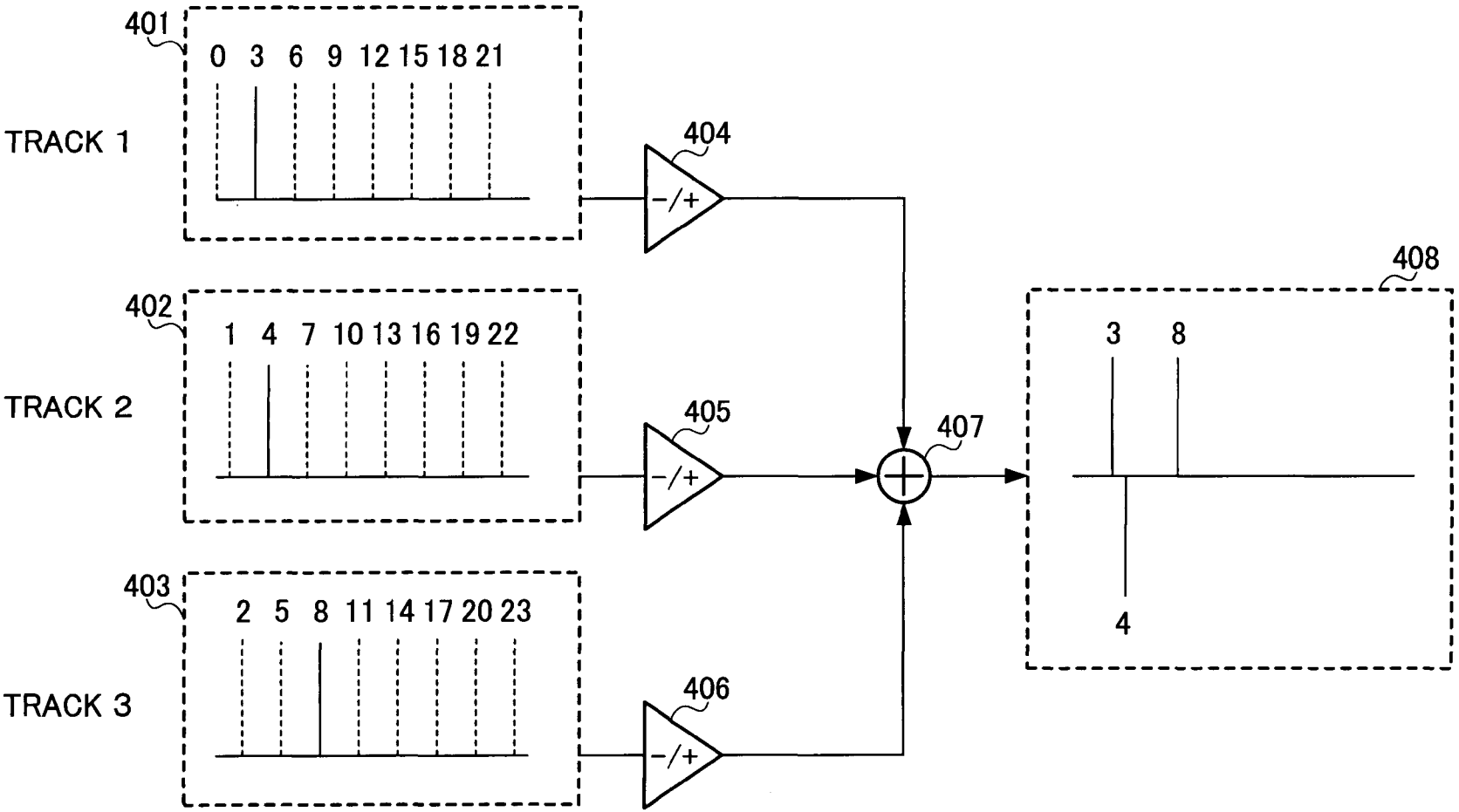
FIG. 9 outlines processing of determining a first fixed excitation vector.

FIG. 9 outlines processing of determining a first fixed excitation vector by parameter determining section 113 in first encoding section 115. This figure indicates the process of generating a first fixed excitation vector from an algebraic fixed excitation codebook.

Track 1, track 2, and track 3 each generate one unit pulse (having an amplitude value of 1). Also, multiplier 404, multiplier 405, and multiplier 406 assign polarity to the unit pulse generated by tracks 1 to 3. Adder 407 adds the generated three unit pulses together, and vector 408 is a first fixed excitation vector consisting of three unit pulses.

Each track has different position where a unit pulse can be generated, and in this figure, the tracks are configured such that track 1 raises a unit pulse at any of eight positions {0, 3, 6, 9, 12, 15, 18, 21}, track 2 raises a unit pulse at any of eight positions {1, 4, 7, 10, 13, 16, 19, 22}, and track 3 raises a unit pulse at any of eight positions {2, 5, 8, 11, 14, 17, 20, 23}

Polarity is assigned to the generated unit pulse in each track by multipliers 404 to 406, respectively, the three unit pulses are added at adder 407, and first fixed excitation vector 408 resulting from the addition is formed.

In this example, unit pulse has eight patterns of positions and two patterns of position, positive and negative, and three bits for position information and one bit for polarity information are used to represent each unit pulse. Therefore, the fixed excitation codebook has 12 bits in total.

Parameter determining section 113 shifts the generation position of the three unit pulses and polarity, and sequentially indicates the generation position and polarity to fixed excitation codebook 108.

Fixed excitation codebook 108 configures first fixed excitation vector 408 using the generation position and polarity indicated by parameter determining section 113, and outputs the configured first fixed excitation vector 408 to multiplier 110.

Parameter determining section 113 obtains an encoding distortion outputted from auditory weighting section 112 for all combinations of the generation positions and polarity, and determines a combination of the generation positions and polarity that minimizes the encoding distortion. Next, parameter determining section 113 outputs the first fixed excitation vector code (F1) indicating the combination of the generation positions and polarity that minimizes the encoding distortion to multiplexing section 114.

Next, processing will be described where parameter determining section 113 in first encoding section 115 indicates quantized gain generating section 107 and determines a first quantized adaptive excitation gain and a first quantized fixed excitation gain. Here, description will be made with an example where 8 bits are assigned to the first quantized excitation gain code (G1).

Quantized gain generating section 107 is provided with a first excitation gain codebook in which 256 variants of first excitation gain code vectors [$gain_1^{(K1')}$ (i)] created in advance are stored. Here, K1' is an index attached to the first excitation gain code vector, and takes any value of 0 to 255. Also, $gain_1^{(K1')}$ (i) is a two-dimensional vector, and i takes a value from 0 to 1.

Parameter determining section 113 sequentially indicates a value of K1' from 0 to 255 to quantized gain generating section 107. Quantized gain generating section 107 selects a first excitation gain code vector [$gain_1^{(K1')}$ (i)] from the first excitation gain codebook using K1' indicated by parameter determining section 113, outputs $gain_1^{(K1')}$ (0) to multiplier 109 as a first quantized adaptive excitation gain and $gain_1^{(K1')}$ (1) to multiplier 110 as a first quantized fixed excitation gain.

As described above, $gain_1^{(K1')}$ (0) obtained by quantized gain generating section 107 represents the first quantized adaptive excitation gain, and $gain_1^{(K1')}$ (1) represents the first quantized fixed excitation gain.

Parameter determining section 113 obtains an encoding distortion outputted from auditory weighting section 112 for all K1' and determines a value of K1' (K1'min) that minimizes the encoding distortion. Next, parameter determining section 113 outputs K1'min to multiplexing section 114 as a first quantized excitation gain code (G1).

In the above, speech encoding apparatus 100 according to this embodiment has been described in detail.

Next, speech decoding apparatus 150 according to this embodiment will be described where the encoded information S12 and S14 transmitted from the above-configured speech encoding apparatus 100 are decoded.

As already shown in FIG. 1, the main configurations of speech decoding apparatus 150 are provided by first decodingsection160, second decoding section180, signal control section 195, and demultiplexing section 155. Sections of speech decoding apparatus 150 perform the following operations.

Demultiplexing section 155 demultiplexes the mode information and the encoded information multiplexed and outputted from speech encoding apparatus 100, and outputs the first encoded information S12 to first decoding section 160 when the mode information is "0" and "1", the second encoded information S14 to second decoding section 180 when the mode information is "1". Also, demultiplexing section 155 outputs the mode information to signal control section 195.

First decoding section 160 decodes the first encoded information S12 outputted from demultiplexing section 155 by using a CELP scheme speech decoding method (first decoding) , and outputs a first decoded signal S52 obtained by decoding to signal control section 195. Also, first decoding section 160 outputs the first parameter group S51 obtained in the decoding to second decoding section 180.

Second decoding section 180 performs a second decoding process using the first parameter group S51 outputted from first decoding section 160, which will be described later, performs decoding on the second encoded information S14 outputted from demultiplexing section 155, generates a second decoded signal S53 and outputs the result to signal control section 195

Signal control section 195 inputs the first decoded signal S52 outputted from first decoding section 160 and the second decoded signal S53 outputted from second decoding section 180, and outputs a decoded signal in accordance with the mode information outputted from demultiplexing section 155. Specifically, first decoded signal S52 is outputted as an output signal when the mode information is "0" and the second decoded signal S53 is outputted as an output signal when the mode information is "1".

Figure 10:
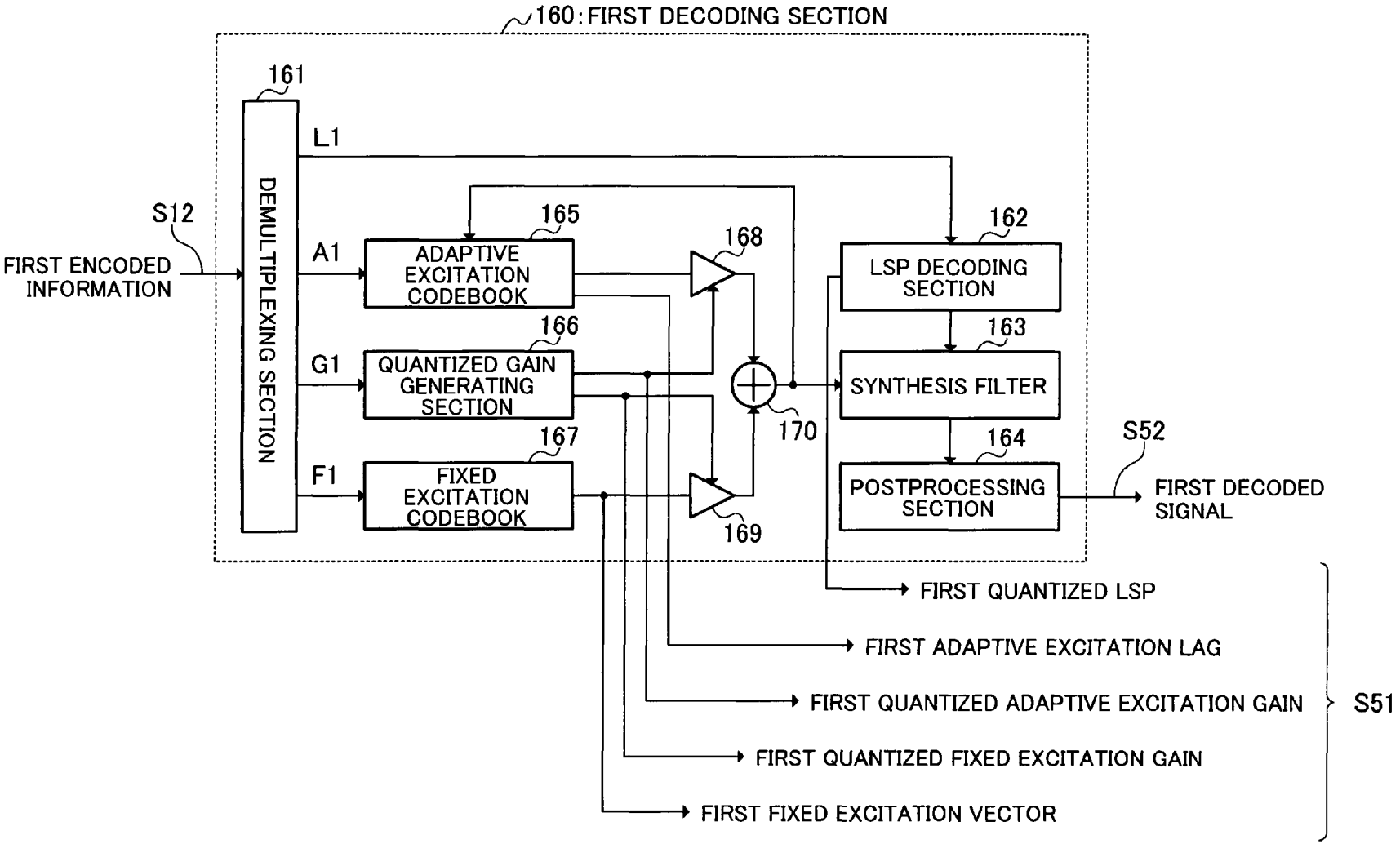
FIG. 10 is a block diagram showing an internal configuration of a first decoding section according to Embodiment 1.

FIG. 10 is a block diagram showing an internal configuration of first decoding section 160.

Demultiplexing section 161 demultiplexes the first encoded information S12 inputted to first decoding section 160 into individual codes (L1, A1, G1, and F1), and outputs codes to each component. Specifically, the first quantized LSP code (L1) demultiplexed from the first encoded information S12 is outputted to LSP decoding section 162, the first adaptive excitation lag code (A1) demultiplexed as well is outputted to adaptive excitation codebook 165, the first quantized excitation gain code (G1) demultiplexed as well is outputted to quantized gain generating section 166, and first fixed excitation vector code (F1) demultiplexed as well is outputted to fixed excitation codebook 167.

LSP decoding section 162 decodes the first quantized LSP code (L1) outputted from demultiplexing section 161 to a first quantized LSP, and outputs the decoded first quantized LSP to synthesis filter 163 and second encoding section 180.

Adaptive excitation codebook 165 extracts a set of samples for one frame from the buffer at an extraction position specified by the first adaptive excitation lag code (Al) outputted from demultiplexing section 161, and outputs the extracted vector to multiplier 168 as a first adaptive excitation vector. Also, adaptive excitation codebook 165 outputs the extraction position specified by the first adaptive excitation lag code (A1) to second decoding section 180 as a first adaptive excitation lag.

Quantized gain generating section 166 decodes the first quantized adaptive excitation gain and the first quantized fixed excitation gain specified by the first quantized excitation gain code (G1) outputted from demultiplexing section 161. Then, quantized gain generating section 166 outputs the obtained first quantized adaptive excitation gain to multiplier 168 and second decoding section 180, and also the first quantized fixed excitation gain to multiplier 169 and second decoding section 180.

Fixed excitation codebook 167 generates a first fixed excitation vector specified by the first fixed excitation vector code (F1) outputted from demultiplexing section 161, and outputs the vector to multiplier 169 and second decoding section 180.

Multiplier 168 multiplies the first adaptive excitation vector by the first quantized adaptive excitation gain, and outputs the result to adder 170. Multiplier 169 multiplies the first fixed excitation vector by the first quantized fixed excitation gain, and outputs the result to adder 170. Adder 170 adds the first adaptive excitation vector and the first fixed excitation vector after gain multiplication outputted from multipliers 168 and 169, generates a driving excitation, and outputs the generated driving excitation to synthesis filter 163 and adaptive excitation codebook 165.

Synthesis filter 163 performs filer synthesis using the driving excitation outputted from adder 170 and the filter coefficient decoded by LSP decoding section 162, and outputs a synthesis signal to postprocessing section 164.

Postprocessing section 164 processes the synthesis signal outputted from synthesis filter 163 by performing processing for improving a subjective speech quality, such as formant emphasizing or pitch emphasizing, and by performing processing for improving a subjective stationary noise quality , and outputs the processed result as a first decoded signal S52.

Here, the reproduced parameters are outputted to second decoding section 180 as the first parameter group S51.

Figure 11:
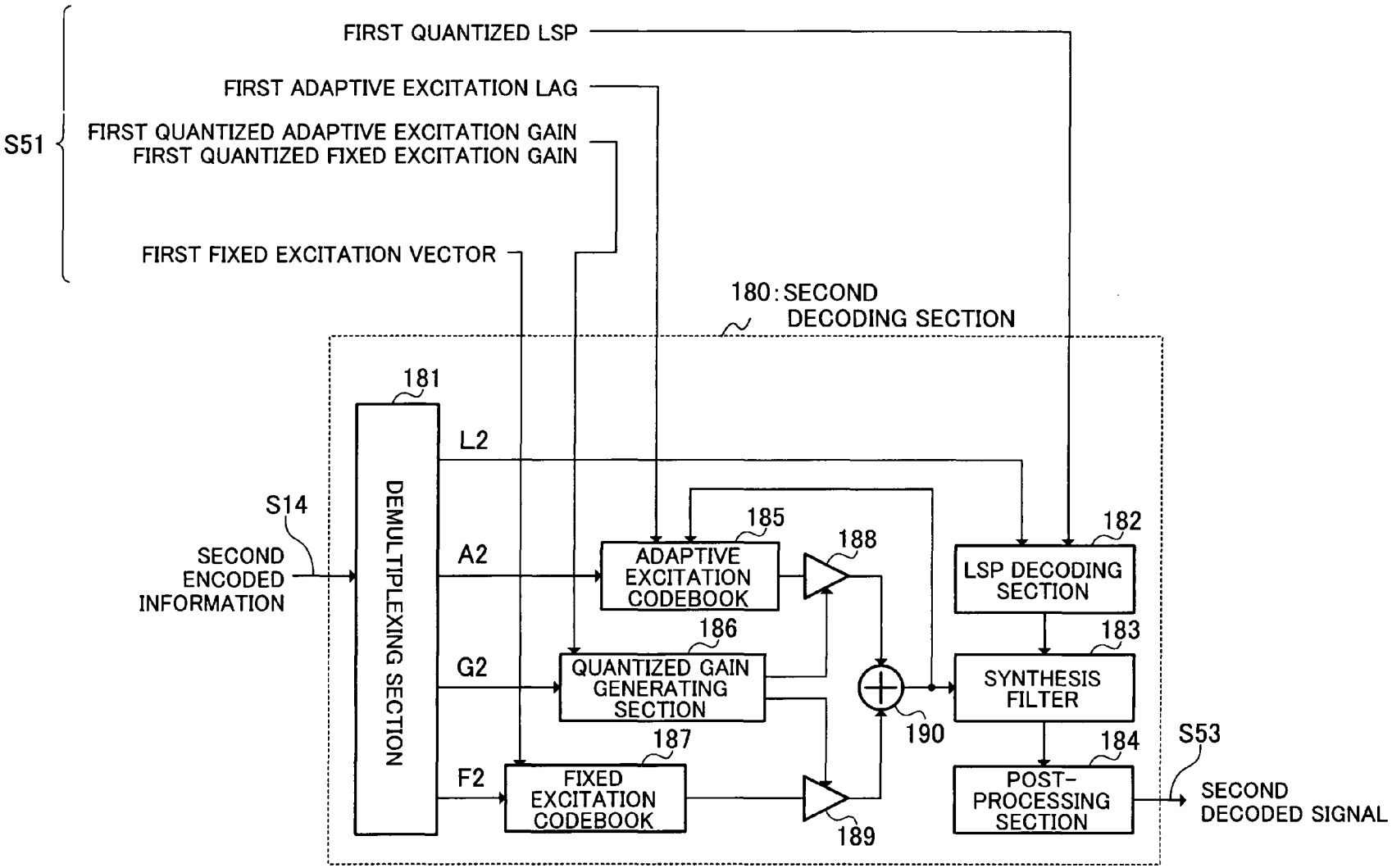
FIG. 11 is a block diagram showing an internal configuration of a second decoding section according to Embodiment 1.

FIG. 11 is a block diagram showing an internal configuration of second decoding section 180.

Demultiplexing section 181 demultiplexes the second encoded information S14 inputted to second decoding section 180 into individual codes (L2, A2, G2, and F2), and outputs codes to each component. Specifically, the second quantized LSP code (L2) demultiplexed from the second encoded information S14 is outputted to LSP decoding section 182, the second adaptive excitation lag code (A2) demultiplexed as well is outputted to adaptive excitation codebook 185, the second quantized excitation gain code (G2) demultiplexed as well is outputted to quantized gain generating section 186, and the second fixed excitation vector code (F2) demultiplexed as well is outputted to fixed excitation codebook 187.

LSP decoding section 182 decodes the second quantized LSP code (L2) outputted from demultiplexing section 181 to a quantized residual LSP, adds the quantized residual LSP and the first quantized LSP outputted from first decoding section 160, and outputs a second quantized LSP resulting from the addition to synthesis filter 183.

Adaptive excitation codebook 185 extracts a set of samples for one frame from the buffer at an extraction position specified by the first adaptive excitation lag outputted from first decoding section 160 and the second adaptive excitation lag code (A1) outputted from demultiplexing section 181, and outputs the extracted vector to multiplier 188 as a second adaptive excitation vector.

Quantized gain generating section 186 obtains a second quantized adaptive excitation gain and a second quantized fixed excitation gain using the first quantized adaptive excitation gain and the first quantized fixed excitation gain outputted from first decoding section 160 and the second quantized excitation gain code (G2) outputted from demultiplexing section 181, and outputs the second quantized adaptive excitation gain to multiplier 188 and the second quantized fixed excitation gain to multiplier 189.

Fixed excitation codebook 187 generates a residual fixed excitation vector specified by the second fixed excitation vector code (F2) outputted from demultiplexing section 181, adds the generated residual fixed excitation vector and the first fixed excitation vector outputted from first decoding section 160, and outputs a second fixed excitation vector resulted from the addition to multiplier 189.

Multiplier 188 multiplies the second adaptive excitation vector by the second quantized adaptive excitation gain, and outputs the result to adder 190. Multiplier 189 multiplies the second fixed excitation vector by the second quantized fixed excitation gain, and outputs the result to adder 190. Adder 190 generates a driving excitation by adding the second adaptive excitation vector gain multiplied by multiplier 188 and the second fixed excitation vector gain multiplied by multiplier 189, and outputs the generated driving excitation to synthesis filter 183 and adaptive excitation codebook 185.

Synthesis filter 183 performs filer synthesis using the driving excitation outputted from adder 190 and a filter coefficient decoded by LSP decoding section 182, and outputs a synthesis signal to postprocessing section 184.

Postprocessing section 184 processes the synthesis signal outputted from synthesis filter 183 by performing processing for improving a subjective speech quality, such as formant emphasizing or pitch emphasizing, and by performing for improving a subjective stationary noise quality, and outputs the processed signal as a second decoded signal S53.

In the above, speech decoding apparatus 150 has been described in detail.

As described above, according to the speech decoding apparatus of this embodiment, the first decoded signal is generated from the first parameter group obtained by decoding the first encoded information, the second decoded signal is generated from the second parameter group obtained by decoding the second encoded information and the first parameter group, and thereby these signals can be obtained as output signals. Also, when only the first encoded information is used, by generating the first decoded signal from the first parameter group obtained by decoding the first encoded information, this signal can be obtained as an output signal. That is, by adopting a configuration capable of obtaining an output signal using all or part of the encoded information, a function capable of decoding speech/sound even from part of encoded information (hierarchical encoding) can be implemented.

Also, in the above configuration, first decoding section 160 performs decoding on the first encoded informationS12 and also outputs the first parameter group S51 obtained in this decoding to second decoding section 180, and second decoding section 180 decode the second encoded information S14 using this first parameter group S51. By adopting this configuration, the speech decoding apparatus according to this embodiment can decode a signal hierarchically encoded by the speech encoding apparatus according to the present invention.

Here, in this embodiment, a case has been described as an example where parameter decoding section 120 demultiplexes individual codes (L1, A1, G1, and F1) from the first encoded information S12 outputted from first encoding section 115, but the multiplexing and demultiplexing procedure may be omitted by directly inputting each of the codes from first encoding section 115 to parameter decoding section 120.

Also, in this embodiment, a case has been described as an example where, in speech encoding apparatus 100, the first fixed excitation vector generated by fixed excitation codebook 108 and the second fixed excitation vector generated by fixed excitation codebook 138 are formed by pulses, but vectors may be formed by spread pulses.

Further, in this embodiment, a case has been described with an example of hierarchical encoding of two layers, but the number of layers is not restricted to this, and the number of layers may be three or more.

Embodiment 2

Figure 12A:
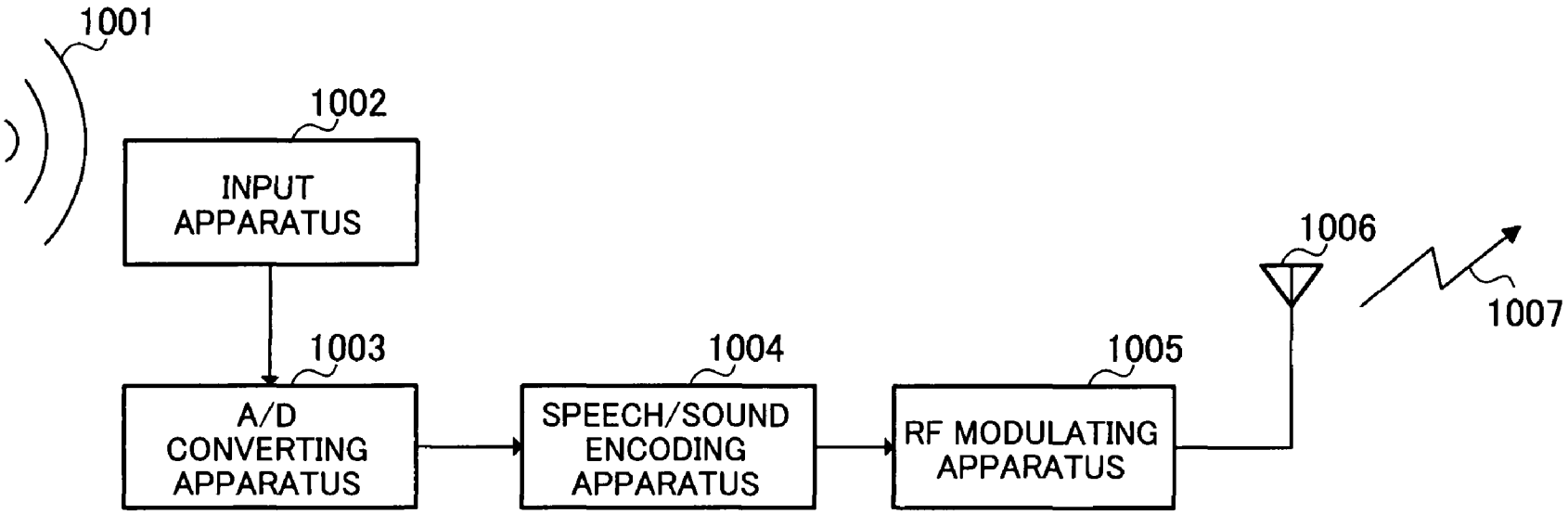
FIG. 12A is a block diagram showing a configuration of a speech/sound transmitting apparatus according to Embodiment 2.

FIG. 12A is a block diagram showing a configuration of speech/sound transmitting apparatus according to Embodiment 2 having incorporated therein speech encoding apparatus 100 described in Embodiment 1.

Speech/sound signal 1001 is converted by input apparatus 1002 into an electrical signal, and outputted to A/D converting apparatus 1003. A/D converting apparatus 1003 converts a (analog) signal outputted from input apparatus 1002 into a digital signal, and outputs the digital signal to speech/sound encoding apparatus 1004. Speech/sound encoding apparatus 1004 incorporates speech encoding apparatus 100 shown in FIG. 1, encodes the digital speech/sound signal outputted from A/D converting apparatus 1003 and outputs the encoded information to RF modulating apparatus 1005. RF modulating apparatus 1005 converts the encoded information outputted from speech/sound encoding apparatus 1004 to a signal to transmit on a propagation medium, such as a radio wave, and outputs the signal to transmission antenna 1006. Transmission antenna 1006 transmits the output signal outputted from RF modulating apparatus 1005 as a radio wave (RF signal). RF signal 107 in the figure represents a radio wave (RF signal) sent from transmission antenna 1006.

The above outlines the configuration and operation of the speech/sound signal transmitting apparatus.

Figure 12B:
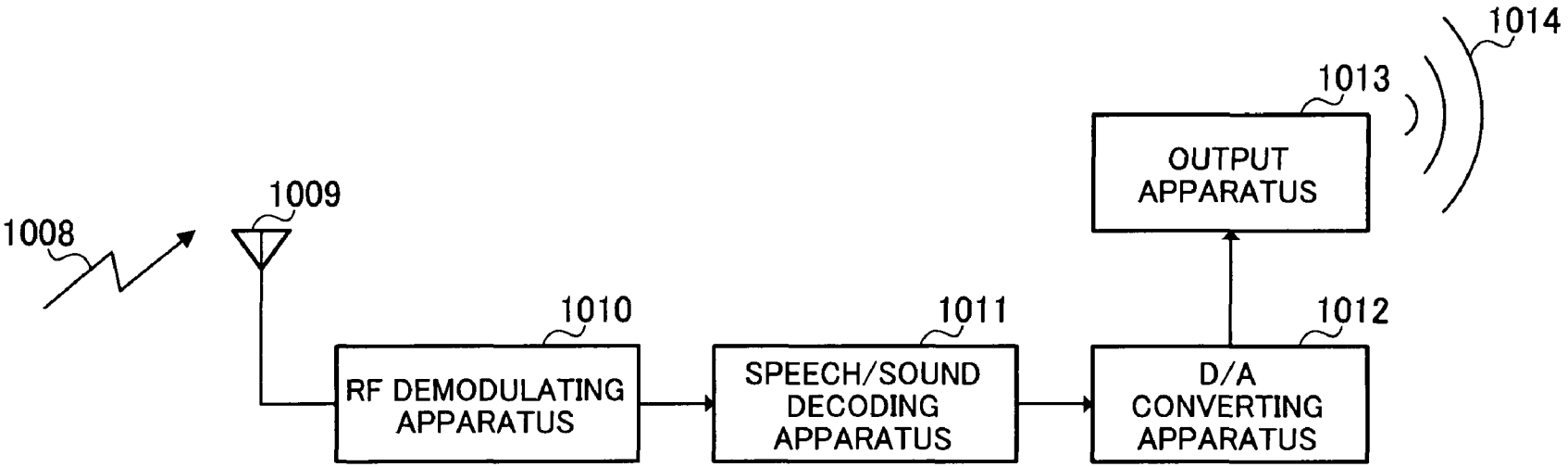
FIG. 12B is a block diagram showing a configuration of a speech/sound receiving apparatus according to Embodiment 2.

FIG. 12B is a block diagram showing the configuration of a speech/sound receiving apparatus according to Embodiment 2 having incorporated therein speech decoding apparatus 150 described in Embodiment 1.

RF signal 1008 is received by reception antenna 1009 and output to RF demodulating apparatus 1010. In the figure, RF signal 1008 represents the radio wave received by reception antenna 1009, and is identical to RF signal 1007, unless the signal is attenuated or noise is superimposed on it in a propagation path.

RF demodulating apparatus 1010 demodulates the RF signal outputted from reception antenna 1009 into encode information, and outputs the encoded information to speech/sound decoding apparatus 1011. Speech/sound decoding apparatus 1011 incorporates speech decoding apparatus 150 shown in FIG. 1, decodes the speech/sound signal from the encoded information outputted from RF demodulating apparatus 1010, and outputs the encoded information to D/A converting apparatus 1012. D/A converting apparatus 1012 converts the digital speech/sound signal outputted from speech/sound decoding apparatus 1011 into an analog electrical signal, and outputs the signal to output apparatus 1013. Output apparatus 1013 converts the electrical signal into air vibration, and outputs it as acoustic waves that can be heard by human ears. In the figure, reference numeral 1014 indicates outputted acoustic wave.

The above outlines the configuration and operation of the speech/sound signal receiving apparatus.

By providing the above speech/sound signal transmitting apparatus and speech/sound signal receiving apparatus in a base station apparatus and a communication terminal apparatus in a wireless communication system, high quality output signal can be obtained.

As described above, according to this embodiment, the speech encoding apparatus and speech decoding apparatus according to the present invention can be implemented in the speech/sound signal transmitting apparatus and the speech/sound signal receiving apparatus.

Embodiment 3

In Embodiment 1, a case has been described as an example in which the speech encoding method according to the present invention, that is, processing mainly performed by parameter decoding section 120 and second encoding section 130, is performed at the second layer. However, the speech encoding method according to the present invention can be performed not only at the second layer but also at another enhancement layer. For example, in the case of hierarchical encoding of three layers, the speech encoding method of the present invention may be performed at both the second layer and the third layer. Such embodiment will be described below in detail.

Figure 13:
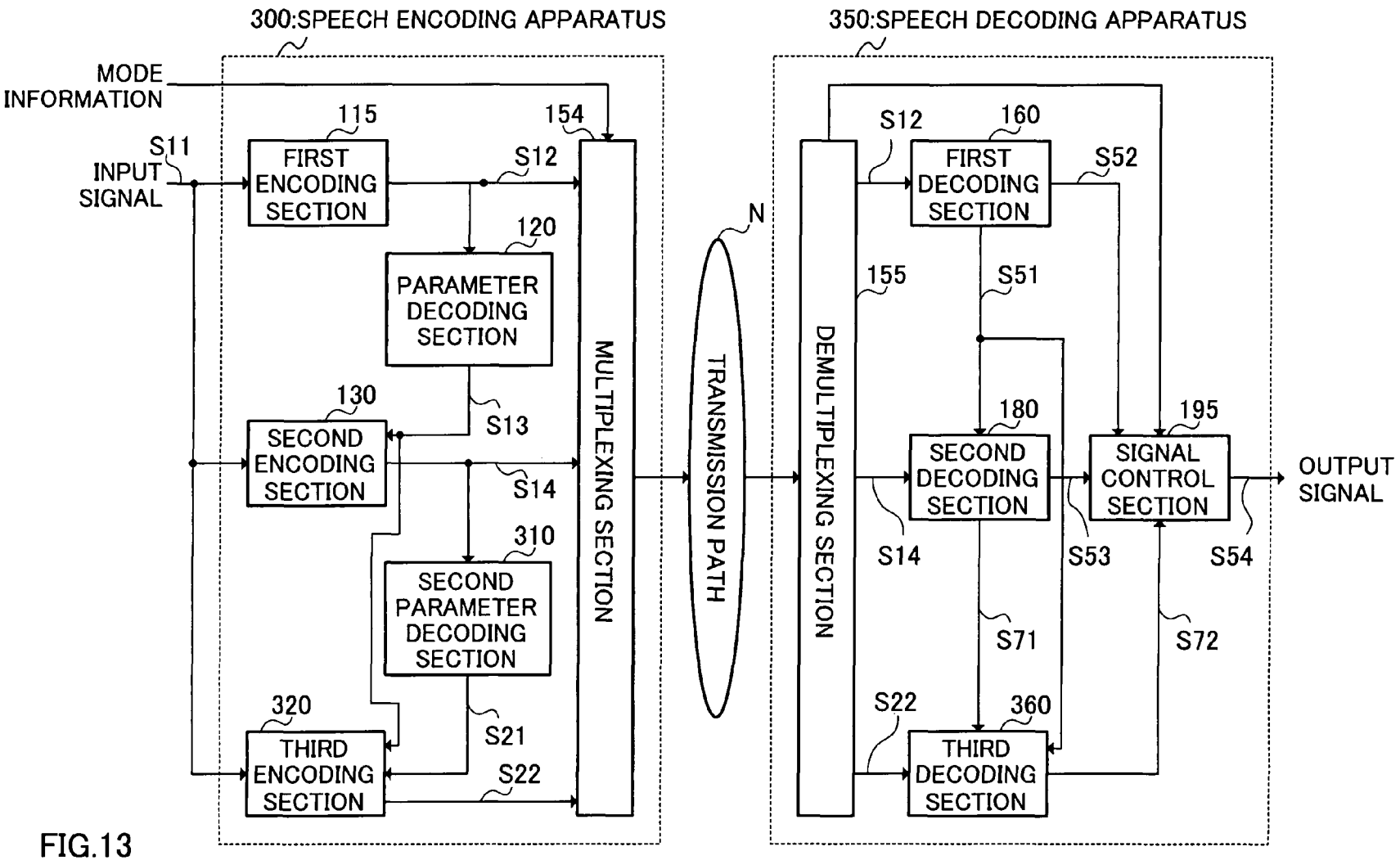
FIG. 13 is a block diagram showing the main configurations of a speech encoding apparatus and a speech decoding apparatus according to Embodiment 3.

FIG. 13 is a block diagram showing the main configurations of speech encoding apparatus 300 and speech decoding apparatus 350 according to Embodiment 3. Here, these speech encoding apparatus 300 and speech decoding apparatus 350 have a basic configuration similar to that of speech encoding apparatus 100 and speech decoding apparatus 150 shown in Embodiment 1. The same components are assigned the same reference numerals and the description thereof will be omitted.

First, speech encoding apparatus 300 will be described. The speech encoding apparatus 300 is further provided with second parameter decoding section 310 and third encoding section 320 in addition to the configuration of speech encoding apparatus 100 shown in Embodiment 1.

First parameter decoding section 120 outputs the first parameter group S13 obtained by parameter decoding to second encoding section 130 and third encoding section 320.

Second encoding section 130 obtains a second parameter group by a second encoding process, and outputs second encoded information S14 representing this second parameter group to multiplexing section 154 and second parameter decoding section 310.

Second parameter decoding section 310 performs parameter decoding, which is similar to that of first parameter decoding section 120, on the second encoded information S14 outputted from second encoding section 130. Specifically, second parameter decoding section 310 demultiplexes the second decoded information S14, and obtains a second quantized LSP code (L2) , a second adaptive excitation lag code (A2), a second quantized excitation gain code (G2) , and a second fixed excitation vector code (F2), and obtains a second parameter group S21 from each of the obtained codes. The second parameter group S21 is outputted to third encoding section 320.

Third encoding section 320 performs a third encoding process using the input signal S11 of speech encoding apparatus 300, the first parameter group S13 outputted from first parameter decoding section 120, and the second parameter group S21 outputted from second parameter decoding section 310, thereby obtaining a third parameter group, and outputs encoded information (third encoded information) S22 representing this third parameter group to multiplexing section 154. The third parameter group is composed of, correspondingly to the first and second parameter groups, a third quantized LSP, a third adaptive excitation lag, a third fixed excitation vector, a third quantized adaptive excitation gain, and a third quantized fixed excitation gain.

The first encoded information is inputted to multiplexing section 154 from first encoding section 115, the second encoded information is inputted from second encoding section 130, and the third encoded information is inputted from third encoding section 320. According to the mode information inputted to speech encoding apparatus 300, multiplexing section 154 multiplexes each piece of encoded information and mode information, and generates multiplexed encoded information (multiplexed information). For example, when the mode information is "0", multiplexing section 154 multiplexes the first encoded information and the mode information. When the mode information is "1", multiplexing section 154 multiplexes the first encoded information, the second encoded information, and the mode information. When the mode information is "2", multiplexing section 154 multiplexes the first encoded information, the second encoded information, the third encoded information, and the mode information. Next, multiplexing section 154 outputs the multiplexed information after multiplexing to speech decoding apparatus 350 via the transmission path N.

Next, speech decoding apparatus 350 will be described. The speech decoding apparatus 350 is further provided with third decoding section 360 in addition to the configuration of speech decoding apparatus 150 shown in Embodiment 1.

Demultiplexing section 155 demultiplexes the mode information and the encoded information outputted from speech encoding apparatus 300 after multiplexing, and outputs the first encoded information S12 to first decoding section 160 when the mode information is "0", "1", or "2", the second encoded information S14 to second decoding section 180 when the mode information is "1" or "2", and the third encoded information S22 to third decoding section 360 when the mode information indicates "2".

First decoding section 160 outputs the first parameter group S51 obtained in the first decoding to second decoding section 180 and third decoding section 360.

Second decoding section 180 outputs the second parameter group S71 obtained in the second decoding to third decoding section 360.

Third decoding section 360 performs a third decoding process on the third encoded information S22 outputted from demultiplexing section 155 using the first parameter group S51 outputted from first decoding section 160 and the second parameter group S71 outputted from second decoding section 180. Third decoding section 360 outputs a third decoded signal S72 generated by this third decoding process to signal control section 195.

According to the mode information outputted from demultiplexing section 155, signal control section 195 outputs the first decoded signal S52, the second decoded signal S53, or the third decoded signal S72 as a decoded signal. Specifically, when the mode information is "0", the first decoded signal S52 is outputted. When the mode information is "1", the second decoded signal S53 is outputted. When the mode information is "2", the third decoded signal S72 is outputted.

As described above, according to this embodiment, in hierarchical encoding with three layers, the speech encoding method according to the present invention can be implemented in both of the second layer and the third layer.

Here, this embodiment shows that, in hierarchical encoding with three layers, the speech encoding method according to the present invention is implemented in both of the second layer and the third layer, but the speech encoding method according to the present invention may be implemented only in the third layer.

The speech encoding apparatus and the speech decoding apparatus according to the present invention are not limited to the above Embodiments 1 to 3, and can be changed and implemented in various ways.

The speech encoding apparatus and the speech decoding apparatus according to the present invention can be incorporated in a communication terminal apparatus or a base station apparatus in mobile communication system or the like, thereby providing a communication terminal apparatus or a base station apparatus having operation effects similar to those described above.

Here, a case has been described as an example where the present invention is implemented with hardware. However, the present invention can also be realized by software.

The present application is based on Japanese Patent Application No. 2004-188755 filed on Jun. 25, 2004, the entire contents of which is incorporated herein by reference.

INDUSTRIAL APPLICABILITY

The speech encoding apparatus, the speech decoding apparatus, and the method thereof according to the present invention can be applied to a communication system or the like where a packet loss occurs depending on the state of a network, or a variable-rate communication system where a bit rate is varied according to the communication state, such as line capacity.

The invention claimed is:

1. A speech encoding apparatus comprising:

a first encoding section that generates, from a speech signal, first encoded information by CELP scheme speech encoding;

a generating section that generates a parameter representing a feature of a generation model of the speech signal, which parameter is any of a quantized LSP (Line Spectral Pairs), an adaptive excitation lag, a fixed excitation vector, a quantized adaptive excitation gain, and a quantized fixed excitation gain from the first encoded information; and a second encoding section that takes the speech signal as an input and encodes the inputted speech signal by CELP scheme speech encoding using the parameter, and generates second encoded information.

2. The speech encoding apparatus according to claim 1, wherein the second encoding section sets a search range of an adaptive excitation codebook based on an adaptive excitation lag generated by the generating section.

3. The speech encoding apparatus according to claim 2, wherein the second encoding section encodes a difference between an adaptive excitation lag obtained by a search of the adaptive excitation codebook and the adaptive excitation lag generated by the generating section.

4. The speech encoding apparatus according to claim 1, wherein the second encoding section adds a fixed excitation vector generated by the generating section to a fixed excitation vector generated from a fixed excitation codebook and encodes a fixed excitation vector obtained by the addition.

5. The speech encoding apparatus according to claim 4, wherein the second encoding section performs the addition by weighting the fixed excitation vector generated by the generating section more than the fixed excitation vector generated from the fixed excitation codebook.

6. The speech encoding apparatus according to claim 1, wherein the second encoding section encodes a difference between an LSP obtained by a linear prediction analysis on the speech signal and a quantized LSP generated by the generating section.

7. The speech encoding apparatus according to claim 1, further comprising a multiplexing section that multiplexes, according to mode information of the speech signal, one or both of the first and the second encoded information with the mode information, and outputs the multiplexed information.

8. A speech decoding apparatus communicating with a speech encoding apparatus that generates, from a speech signal, first encoded information by CELP scheme speech encoding, generates a parameter representing a feature of a generation model of the speech signal, which parameter is any of a quantized LSP (Line Spectral Pairs), an adaptive excitation lag, a fixed excitation vector, a quantized adaptive excitation gain, and a quantized fixed excitation gain from the first encoded information, and generates second encoded information by encoding the speech signal by CELP scheme speech encoding using the parameter, the speech decoding apparatus comprising:

a first decoding section that decodes the first encoded information to generate the parameter; and a second decoding section that decodes the second encoded information using the parameter generated by the first decoding section.

9. The speech decoding apparatus according to claim 8 communicating with the speech encoding apparatus that further multiplexes, according to mode information of the speech signal, one or both of the first and the second encoded information with the mode information, the speech decoding apparatus further comprising:

an output section that outputs a signal decoded by either one of the first and second decoding sections according to the mode information.

10. A speech encoding method comprising:

a first encoding step of generating, from a speech signal, first encoded information by CELP scheme speech encoding;

a generating step of generating a parameter representing a feature of a generation model of the speech signal, which parameter is any of a quantized LSP (Line Spectral Pairs), an adaptive excitation lag, a fixed excitation vector, a quantized adaptive excitation gain, and a quantized fixed excitation gain from the first encoded information; and a second encoding step of encoding the speech signal by CELP scheme speech encoding using the parameter, and generating second encoded information.

11. A speech decoding method communicating with a speech encoding apparatus that generates, from a speech signal, first encoded information by CELP speech encoding, generates a parameter representing a feature of a generation model of the speech signal, which parameter is any of a quantized LSP (Line Spectral Pairs), an adaptive excitation lag, a fixed excitation vector, a quantized adaptive excitation gain and a quantized fixed excitation gain from the first encoded information, and generates second encoded information by encoding the speech signal by CELP scheme speech encoding using the parameter, the speech decoding apparatus comprising:

a first decoding step of decoding the first encoded information to generate the parameter; and a second decoding step of decoding the second encoded information using the parameter generated in the first decoding step.

* * * * *